US006985680B2

(12) United States Patent
Sakai et al.

(10) Patent No.: US 6,985,680 B2
(45) Date of Patent: Jan. 10, 2006

(54) IMAGE FORMING APPARATUS

(75) Inventors: Hiroaki Sakai, Shizuoka (JP); Hiroshi Takami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 99 days.

(21) Appl. No.: 10/793,733

(22) Filed: Mar. 8, 2004

(65) Prior Publication Data

US 2004/0202487 A1 Oct. 14, 2004

(30) Foreign Application Priority Data

Apr. 10, 2003 (JP) ..... 2003-107056
Apr. 21, 2003 (JP) ..... 2003-116254

(51) Int. Cl.
*G03G 15/02* (2006.01)

(52) U.S. Cl. ..... 399/50

(58) Field of Classification Search ..... 399/50
See application file for complete search history.

(56) References Cited

U.S. PATENT DOCUMENTS 5,450,180 A * 9/1995 Ohzeki et al. ..... 399/50
5,915,145 A 6/1999 Shimura et al. ..... 399/66
6,498,908 B2 * 12/2002 Phillips et al. ..... 399/48
6,532,347 B2 3/2003 Watanabe et al. ..... 399/50
6,539,184 B2 * 3/2003 Shimura et al. ..... 399/50
6,564,023 B2 * 5/2003 Takami et al. ..... 399/50
6,591,071 B2 * 7/2003 Hayashi ..... 399/48
6,615,002 B2 * 9/2003 Saito et al. ..... 399/43
6,650,861 B2 * 11/2003 Inukai et al. ..... 399/314
6,842,591 B2 * 1/2005 Shim et al. ..... 399/50
6,868,241 B2 * 3/2005 Takami ..... 399/50
6,898,385 B2 * 5/2005 Ito et al. ..... 399/50
6,917,770 B2 * 7/2005 Bae et al. ..... 399/44
2001/0019669 A1 9/2001 Watanabe et al. ..... 399/50
2004/0013439 A1 1/2004 Takami ..... 399/50

FOREIGN PATENT DOCUMENTS

JP 2001-201921 7/2001

* cited by examiner

*Primary Examiner*—G. Bradley Bennett
*Assistant Examiner*—Amy R. Cohen
(74) *Attorney, Agent, or Firm*—Fitzpatrick, Cella, Harper & Scinto

(57) ABSTRACT

An AC voltage from a power generating circuit is applied to a charge roller. CPU controls the power generating circuit so as to flow a constant current according to a control value through a current path from the power generating circuit to the charge roller. CPU produces an information according to an peak value of the AC voltage applied to the charge roller. CPU produces an information according to the AC voltage applied to the charge roller when the AC voltage is in a predetermined phase.

19 Claims, 28 Drawing Sheets

IMAGE FORMING APPARATUS

This application claims priority from Japanese Patent Application Nos. 2003-107056 filed Apr. 10, 2003 and 2003-116254 filed Apr. 21, 2003, which are incorporated hereinto by reference.

BACKGROUND OF THE INVENTION

1. Field of the Invention

The present invention relates to an image forming apparatus, more particularly to an electro-photography type image forming apparatus for forming images while charging an image carrier.

2. Description of the Related Art

An electro-photography type image forming apparatus is designed, as known generally, to uniformly charge a surface of a photoconductor drum as being a drum type electrophotographic receptor. Conventionally, however, the corona electrifying method, characterized by having a corona occurring when a high voltage is applied to a thin corona discharging wire act on the surface of the photoconductor drum, has been commonly employed method. Recently, however, the contact charging method, advantageous in terms of the low-pressure process, the low ozone generation, the low cost, etc is getting popular. This method is characterized, for example, by that the charge roller, as being a charging roller member, is made to come into contact with the surface of the photoconductor drum thereby to apply a voltage to the charge roller to electrify the photoconductor drum.

The voltage to be applied to the charge roller may be DC voltage alone, but the AC voltage may also be applied so that the discharge to the positive and the negative can be made alternately for uniformly charging. For instance, it is known that charging the member to be charged can be made evenly when, for example, an oscillating voltage, obtained by superposing the AC voltage with a DC voltage (DC offset bias), such AC voltage having a peak-to-peak voltage equal to or higher than a discharge starting threshold voltage (charging start voltage) available when an AC voltage is applied.

When a sinusoidal AC voltage is applied to the charge roller, there occurs a resistive load current to flow in a resistive load between the charge roller and the photoconductor drum, a capacitive load current to flow in a capacitive load between the charge roller and the photoconductor drum, and a discharging current to flow between the charge roller and the photoconductor drum. The sum of these currents will flow in the charge roller. It is empirically known that an amount of the discharging current should be kept equal to or greater than a predetermined amount in order to maintain the discharge stable.

FIG. 1 shows a characteristic of the current Ic flowing through the charge roller when the charging voltage Vc is applied to the charge roller. In this case, Vc on the x-axis represents a peak value of the AC voltage, while the charging current Ic on the y-axis represents an effective value of the alternating current.

Gradually increasing the amplitude of the charging voltage VC causes the charging current to flow. Where the charging voltage is equal to or lower than the predetermined voltage Vh, the amplitude of the AC voltage is substantially in proportion to the charging current. This is because the discharge current will not flow where the resistance load current and the capacitive load current are in proportion to the voltage amplitude and the voltage amplitude is relatively small. Then, as the applied voltage is raised further, the discharge starts at the predetermined voltage (Vh), and the charging current Ic to the voltage amplitude comes off proportionality relation to flow in a value larger by the value of the discharging current, Is. In order to obtain a stable charge, it is sufficient to set the charging voltage to a level at which the value of the discharging current Is becomes larger than the predetermined value.

However, there have occurred cases where the increase in the amount of the discharge to the photoconductor drum not only accelerates the deterioration thereof such as the damage to the surface of the photoconductor drum but also causes the formation of abnormal image owing to the effect of the high-temperature and high-humidity environment coupled with the products formed during the discharging. Thus, in order to obtain a stable charge as well as to resolve such problem, it is necessary to minimize the discharge to be generated on the positive side and on the negative side alternately by applying the minimum necessary voltage.

Actually, the relationship between the voltage applied to the photoconductor drum and the value of discharge is not always constant but varies with the thickness of the photosensitive layer or dielectric, the material of the charging member and the changing condition of the environment such as the condition of the air. In the low-temperature and low-humidity environment, the material become dry and the resistance thereof become hard to increase, and thus it becomes necessary to apply the perk-to-peak voltage equal to or higher than a certain level. When the charging operation is carried out in a high-temperature and high-humidity environment regardless of that the operating voltage is set to the minimum voltage suiting the charging operation for obtaining a uniform charge in a low-temperature and low-humidity environment, the materials are apt to become too humid to cause a fall of resistance and resulting excessive discharging. Then, such an increase in the amount of discharge can give rise to the problems such as the poor image forming, the fusion of the toner, the cracking on the surface or the shortening of the life of the photoconductor drum.

Besides, it is also known that the fault caused by the change in the level of discharge is resulted also from the causes such as the variation of the quality occurring during manufacturing process, the variation of the resistance value owing to the contamination, the variation of the electrostatic capacity with the laps of time, the variation of the characteristic of the high-voltage generator and so on, in addition to the previously mentioned cause resulting from the variation of the environmental condition.

In order to prevent the changes in the discharge level, "Discharging Current Control Method" has been proposed (Refer to Japanese Patent Application Laid-open No. 2001-201921). In this method, the AC voltage to be applied to the charge member is made variable; the AC values are sampled respectively by the current sampling means at least at two voltage levels, namely, a voltage level lower than the voltage Vh at which the discharge starts and another voltage level equal to or higher than the voltage Vh; the optimal voltage for the optimal level of discharge is calculated to determine the level of the AC voltage to be applied to the charging member.

In FIG. 1, those points indicated by the circles and the corresponding letters, A, B, C and D, represent the points at which (the voltages) are sampled. The characteristics of the charging AC voltage Vc within the range, wherein the discharging current will not occur, and the characteristic of the charging current Ic are measured by sampling (the voltages) at the voltage levels, A and B, which are lower than the voltage Vh, at which the discharge starts. Similarly, two points, C and D, are sampled to measure the characteristic of the applied AC charging voltage Vc and the characteristic of the charging current Ic, within the range where the discharging current will not occur. Since the difference in characteristic between the above-mentioned two voltages corresponds to the discharging current Is, the level of the charging AC voltage, required for obtaining the discharging current of predetermined level, is calculated on the basis of the relationship between the above-mentioned two characteristics, and the level of the charging AC voltage is controlled according to the result of such calculation, thereby controlling the variation of the magnitude of the discharge.

However, the conventional discharge control method is considered to have the problems as set forth below.

(1) The sampling error by the current sampling means, if occurs, adversely affects the accuracy to a considerable extent in controlling the discharging current.

As discussed previously, in the conventional discharging current control method, the discharging current is calculated on the bases of the two relationships namely, the relationship between the characteristic of the discharging AC voltage Vc, sampled at the points (points A and B in FIG. 1), lower than the discharge starting voltage Vh, and the characteristic of the discharging current Ic, and the relationship between the characteristic of the discharging AC voltage Vc, sampled at another point, lower than the discharge starting voltage Vh, and the characteristic of the discharging current Ic. However, the levels of the charging currents at the points A an B differ largely from the levels of the charging currents at the points C and D, and so the occurrence of the sampling error can cause a substantial error of the calculated discharging current. This has been a drawback to the optimal control of the discharging current.

(2) Another drawback to the conventional method is that the continuous printing operation can cause the variation of the charging current magnitude. When carrying out the printing operation in the continuous printing mode, the temperature around the photoconductor drum rises to cause the change in the relationship between the applied voltage to the charge roller and the discharging current and the resulting change in the value of the discharging current. This entails the problem such as the inability for optimal discharging current control. In order to overcome such a problem, it can be devised to stop the printing operation or a predetermined period at predetermined intervals during the printing operation in the continuous printing mode to let the charging AC voltage fall to a level below the discharge starting voltage Vh to sample the level of the alternating current thereby to enable the level of the discharging current to be reset to the optimal level. It has been found, however, that this method cannot be an effective solution, since this method entails the slowdown of the printing speed of the image forming apparatus.

SUMMARY OF THE INVENTION

The object of the present invention is to provide an image forming apparatus capable of providing a uniform charge being free of the problems such as the poor image forming by maintaining a highly accurate predetermined intensity of the discharge regardless of the variation of the characteristic of the charging member resulting from the change in the environmental condition and the manufacturing process, also capable of providing a predetermined charge with high accuracy without causing the slowdown of printing speed, the poor image forming or the like regardless of the variation of the characteristic of the charging member during the continuous printing operation, and further capable of stably maintaining a high image quality and a high (product) quality for a long period of time.

An embodiment of the present invention provides an apparatus for charging an image carrier and for transferring a latent image formed on the image carrier to form an image onto a recording medium. The apparatus comprises generating means for generating an AC voltage, a charge member whereto AC voltage from the generating means is applied, control means for controlling the generating means so as to flow a constant current according to a control value through a current path from the generating means to the charge member, first output means for outputting an information according to an peak value of the AC voltage applied to the charge member, and second output means for outputting an information according to changes in the AC voltage applied to the charge member. The control means sets the control value based on outputs from the first output means and from the second output means when the AC voltage generated by the generating means has a peak value equal to or higher than a discharge starting voltage of the image carrier.

Another embodiment of the present invention provides an apparatus for charging an image carrier and for transferring a latent image formed on the image carrier to form an image onto a recording medium. The apparatus comprises generating means for generating an AC voltage, a charge member whereto AC voltage from the generating means is applied, control means for controlling the generating means so as to flow a constant current according to a control value through a current path from the generating means to the charge member, first output means for outputting an information according to an peak value of the AC voltage applied to the charge member, and second output means for outputting an information according to the AC voltage applied to the charge member when the AC voltage is in a predetermined phase. The control means sets the control value based on outputs from the first output means and from the second output means when the AC voltage generated by the generating means has a peak value equal to or higher than a discharge starting voltage of the image carrier.

The apparatus according to the present invention accomplishes producing the discharge at a constant level and with high accuracy regardless of the variation of the characteristic of the charging member resulting from the environmental condition or the manufacturing condition, providing a uniform charge without causing problems such as the deterioration of the image carrier, the fusion of the toner, poor image formation or the like, continuing the printing operation without causing the slowdown of the operating speed, and further providing a uniform charge regardless of the contamination of the charging member and the variation of the environmental condition, for the maintaining the high quality of the image and the high quality of the apparatus over a long period of time.

Further, the apparatus according to the present invention accomplishes producing a constant discharge with high accuracy.

The above and other objects, effects, features and advantages of the present invention will become more apparent from the following description of embodiments thereof taken in conjunction with the accompanying drawings.

BRIEF DESCRIPTION OF THE DRAWINGS

FIGS. 22A through 22C are charging AC voltage waveform diagrams illustrating the charging characteristics, of which FIG. 22A represents the waveform at the time when the charging is not present; FIG. 22B, the waveform at the time when the charging is present; and FIG. 22C, the waveform at the time when the charging is present in the case of the fifth embodiment (with choke coil);

DETAILED DESCRIPTION OF PREFERRED EMBODIMENTS (The First Embodiment)

Figure 1:
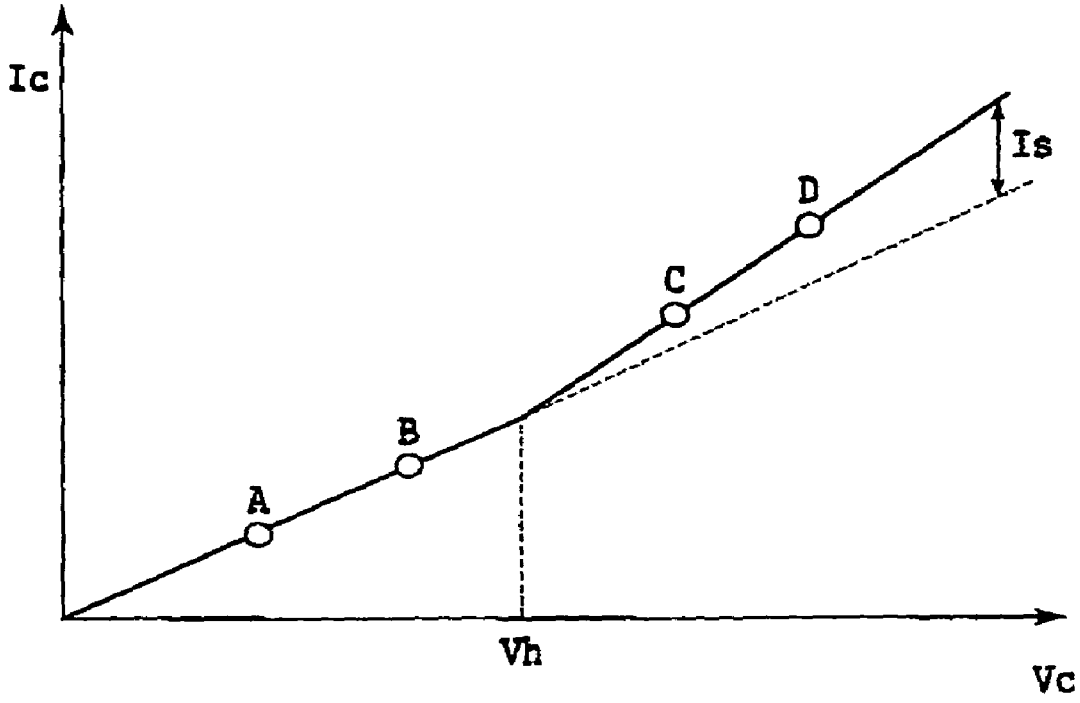
FIG. 1 is a diagram showing the characteristics of the AC charging voltage and the charging current for the charging current control in the conventional image forming apparatus.
Figure 2:
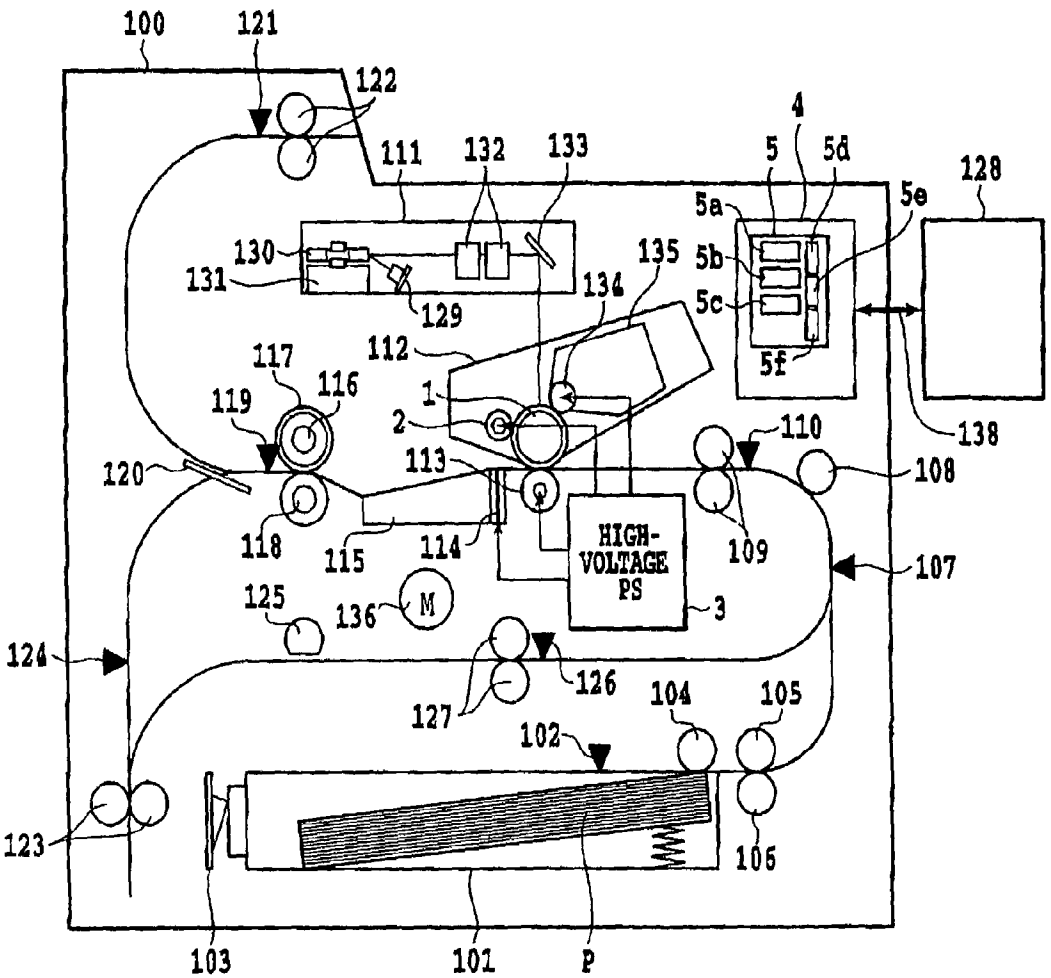
FIG. 2 is a diagram illustrating the compositions of the image forming apparatus as a first through seventh embodiments of the present invention.

The first embodiment of the present invention will be described in the following ref erring to pertinent drawings. FIG. 2 shows the composition of the laser beam printer 100 according to the present embodiment and the $2^{nd}$ through $7^{th}$ embodiments of the present invention.

The laser beam printer 100 comprises a deck 101 for storing the printing sheets P, an in-deck printing sheet detecting sensor 102 for finding the presence or absence of the printing sheets, a sheet size sensor 103 for detecting the size of the printing sheet P in the deck 101, a pick-up roller 104 for taking the printing sheet out of the deck 101, a printing sheet feed roller 105 for transferring the printing sheets P picked up by the pick-up roller 104, and a retard roller 106, constituting a pair with the sheet feed roller 105 to prevent the transfer of overlapped sheets.

On the downstream side of the printing sheet feed roller 105, there are provided a feed sheet sensor 107 for detecting the transfer condition of the feed sheet coming from the deck 101 byway of a reverse turn means, a feed sheet transfer roller 108 for transferring the printing sheet towards further downstream side, a registration roller 109 for synchronized transfer of the printing sheets, and a pre-registration sensor 110 for detecting the condition of the printing sheet P to be transferred to the registration roller 109. Further, on the downstream side of the registration roller 109, there are provided a process cartridge 112 for forming the toner image on a photoconductor drum 1 according to the laser beam coming from a laser scanner 111, a transcribing roller 113 for transcribing the toner image formed on the photoconductor drum 1 onto the printing sheet P, and a discharging needle 114 for removing the charge on the recording sheet P to facilitate separation of (the recording sheet) from the photoconductor drum 1.

On further downstream side of the discharging needle 114, there are provided a transfer guide 115, a pair of a fixing roller 117, containing a halogen heater 116 inside for heating, and a pressure roller 118, a fixed image carrier sheet sensor for ejection 119, and a 2-way action flapper 120 for switching the destination of the printing sheet P transferred from the fixing means to either a sheet ejecting means or a turnaround means. On further downstream side, there are provided an ejected sheet sensor 121 for detecting the condition of the transfer of the ejected sheets from the sheet ejection means and a pair of sheet ejection rollers 122.

Further, on turnover side of the reverse turn means, designed for reversing the printed side of the sheet so as to be transferred back to the image forming means for having the other side thereof used for another printing, there are provided a pair of reverse turn roller pair 123, designed for returning the recording sheet P by turning in normal direction or reverse direction, a returning action sensor 124 for detecting the transfer of the sheet to the reverse turn roller pair 123, a D-shape section roller 125 for transferring the printing sheet P to a horizontal registration means (not shown) for registering the printing sheets with respect to the horizontal direction, a 2-way sensor 126 for detecting the transfer condition of the printing sheet P by the reverse turn means, and a transfer roller pair 127 for transferring the printing sheet P from the reverse turn means to the paper feed means.

The laser scanner 111 comprises a laser unit 129 for emitting the laser light modulated according to the image signal transmitted from an external apparatus 128, the combination of a polygon mirror 130 and a scanner motor 131 for scanning the photoconductor drum with the laser light coming from the laser unit 129, imaging lens group 132 and a turn-back mirror 133. The processing cartridge 112 comprises the photoconductor drum 1, the charge roller 2 and a development roller 134, as being charging members, a toner container 135, etc., which are essential for the known electro-photographic process and is designed for being detachable from the laser beam printer 100. Further, the high-voltage power source 3 incorporates other high-voltage circuits besides the charging high-voltage circuit, which will be described later. The high-voltage circuit supplies necessary voltages to the development roller 234, the transcribing roller 113 and the discharging needle 114.

A main motor 136 supplies the electric power to various parts A printer controller 4 comprises an MPU (microprocessor) 5, incorporating a RAM5*a*, a ROM5*b*, a timer 5*c*, a digital input/output (I/O) port 5*d*, an analog/digital conversion (A/D) input port 5*e*, a digital/analog (D/A) output port 5*f*, and various input/output control circuits (not shown). The printer controller 4 controls the laser beam printer 100. The printer controller 4 is connected with the external apparatus 128, such as the personal computers or the like, through an interface 138.

Figure 3:
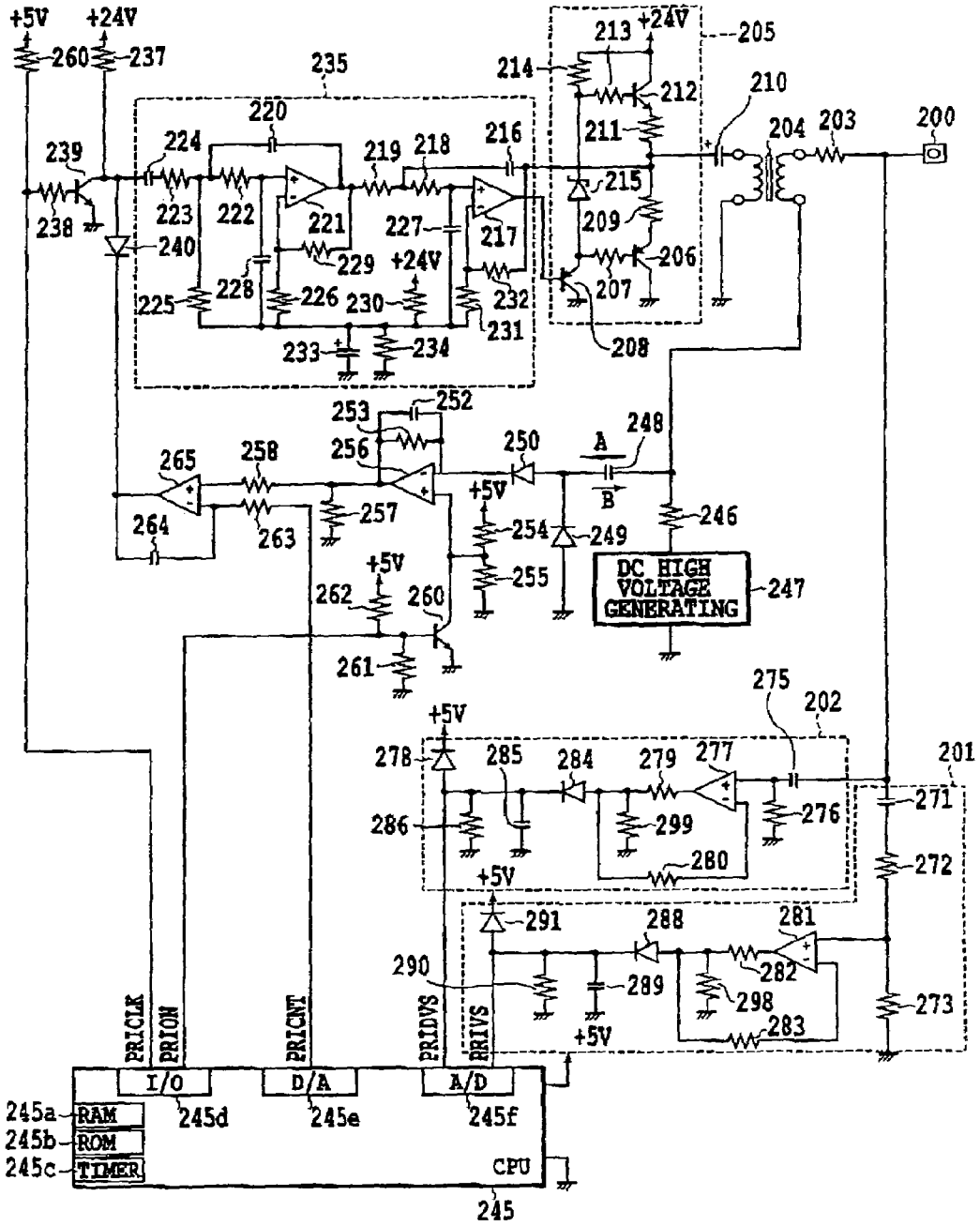
FIG. 3 is a circuit diagram showing the charging high voltage output circuit of the image forming apparatus as the first embodiment of the present invention.

The charging high-voltage control will be described referring to the diagram of the charging high-voltage circuit of FIG. 3. The charging high-voltage output circuit generates a charging high voltage consisting of a high AC voltage superimposed on a DC voltage and is outputted from an output terminal 200. The output terminal 200 is connected with the charge roller 2 being in contact with the photoconductor drum 1.

The base of a transistor 239 is connected with the I/O port 245*d* of a CPU 245 through a base resistor 238; the base resistor 238 is connected with a pull-up resistor 260; an emitter is grounded; a collector is connected with the output terminal of an operation amplifier 265 through a diode 240 and also connected with a pull-up resistor 237. Hence, when a clock pulse (PRICLK) is outputted from an I/O port 245*d* of the CPU 245, the transistor 239 is made to perform a switching action through a pull-up resistor 260 and a base resistor 238.

The switching action of the transistor 239 causes an amplified clock pulse, having an amplitude corresponding to the output of an operational amplifier 265, to be outputted.

This clock pulse is inputted to a filter circuit 235 to cause the filter circuit 235 to output sine wave of mainly +12V level. The filter circuit 235 comprises a capacitor 242, resistors 223 through 232, capacitors 216 through 220, and operational amplifiers 217 and 220.

The power of the sinusoidal output from the filter circuit 235 is amplified by a push-pull high-voltage transformer drive circuit 205 and inputted to the primary winding of a high-voltage transformer 204 through the capacitor 210 and a choke coil 2100 to cause a high AC voltage of the sine wave to be generated by the secondary winding.

One of the terminals of the high-voltage transformer 204 is connected with a DC high-voltage generating circuit 247 through a resistor 246, while the other terminal thereof is connected with an output terminal 200 through a protective output resistor 203. The high-voltage bias provided by superimposing the high AC voltage, generated in the secondary winding, on the high DC voltage, supplied from a high DC voltage generating circuit 247, is outputted from an output terminal 200 through a protective output resistor 203 and supplied to the charge roller 2.

Then, the function of the current detector of the AC high-voltage circuit will be described. The AC current, generated-by driving the previously mentioned AC high-voltage generating circuit, flows through a capacitor 248 in a fashion that the half wave in the direction of an arrow A flows through a diode 250 while the half wave in the direction of an arrow B flows through a diode 249. The half wave in the direction of an arrow A, passed through the diode 250, is inputted to an integrating circuit, comprising the operational amplifier 256, a resistor 253 and a capacitor 252, to be converted to a DC current. The characteristic of the voltage V1 at the output terminal of the operational amplifier 256 can be expressed by the following equation.

$$V1=(Rs\times I\text{mean})+Vt \quad (1)$$

where Imean=Mean value of the half wave of the alternating current; Rs=Resistance value of the resistor 253; Vt= the non-inversion voltage inputted to the operational amplifier 256. The output of the operational amplifier 256 is inputted to the non-inversion input (terminal) thereof to be compared with the level of the current control signal PRICNT inputted to the inversion input (terminal). The AC value is set by the current control signal PRICNT. When the output voltage V1 from the operational amplifier 265 is larger than the current control signal PRICNT, the output of the operational amplifier 265 increases. As mentioned previously, as the output of the operational amplifier 265 increases, the amplitude of the clock pulse inputted to the filter circuit 235 increases to cause the high AC voltage to rise.

With such a composition of the system, the level of the high AC voltage is controlled so that the alternating current is controlled to a value corresponding to the current control signal PRICNT. That is, the constant current control is effected corresponding to the current control signal.

Next, an explanation will be made as to the voltage sampling means of the charging high-voltage output circuit. The charging high-voltage output circuit comprises two sets of voltage detecting circuits, namely, a voltage detecting circuit 201 and a voltage detecting circuit 202.

The voltage detecting circuit 201 detects the peak voltage of the charging AC voltage. The charging output voltage is made to drop to a lower voltage level by being divided by a capacitor 271 and a resistor 273 and inputted to a non-inversion input terminal. The operational amplifier 281, constituting a voltage follower, is driven by both the positive and negative power sources A voltage having both the positive and negative polarities are inputted to the input terminal of the operational amplifier 281 to output the voltage having a positive polarity and the voltage having a negative polarity to the output terminal thereof. The same applies to operational amplifiers 278 and 1003, which will be described later.

Further, the impedance of the capacitor 271 is set so as to be sufficiently smaller than the sum of the impedance of the resistor 272 and the impedance of the resistor 273 so that the phase difference measured between the both ends of the capacitor 271 becomes sufficiently small. Further, since the DC high voltage is interrupted by the capacitor 271, only the AC component is inputted to the non-inversion input terminal of the operational amplifier 281. The AC voltage passes through the operational amplifier 281, and is converted to a DC voltage corresponding to the peak value of the charging AC voltage by means of a peak hold circuit comprising a diode 288, a capacitor 289 and a resistor 290, to be inputted, as a detect signal PRIVS, to an analog input terminal of a CPU 245.

Figure 4A:
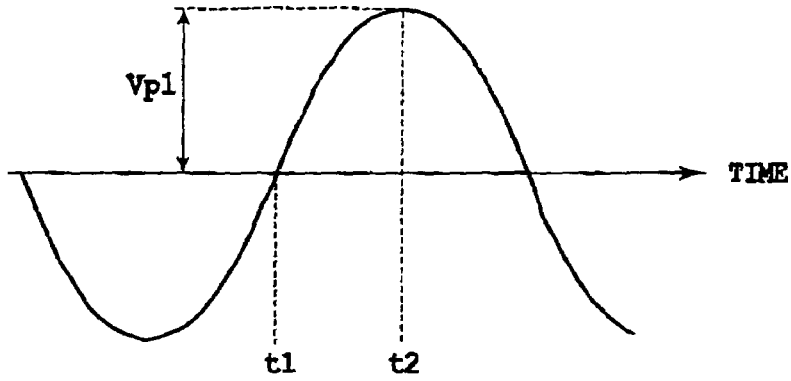
FIG. 4A through FIG. 4C are illustrative diagrams showing the waveform of the charging AC voltage for the first embodiment of the present invention.
Figure 4B:
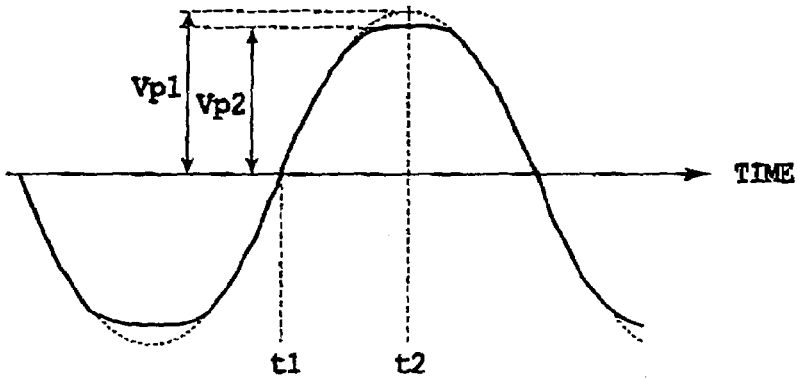

FIGS. 4A and 4B represent the relationship between the charging AC waveform and the value sampled by the voltage detecting circuit 201. FIG. 4A represents the case where the AC waveform is the sine wave. In this case, Vp1 is sampled by a voltage detecting circuit 201. On the other hand, FIG. 4B shows a distorted AC waveform; the time t1 in FIG. 4B coincides with the time t1 shown in FIG. 4A; the time t2 in FIG. 4B coincides with the time t2 in FIG. 4A (In FIG. 4B), the broken line represents the waveform, a sine wave, whose peak is distorted and peak value (Vp2) thereof is lower than the normal peak value Vp1 having no distortion. In such a case, the value of Vp2 is detected by the voltage detecting circuit 201.

Given that the peak value of the charging AC voltage is Vp, and the voltage of a diode 288 descending in normal direction is Vf, the level of the sampled signal PRIVS can be given by the following-expression:

$$PRIVS=\lambda\times Vp-Vf \tag{2}$$

where λ is a constant dependent on the resistors 272 and 273 and the capacitor 271 and can be given by the following expression:

$$\lambda=2\times\pi\times f\times C271\times(R272+R273)\times v\{2\times\pi\times f\times C271\times(R272+R273)\}^2+1/1+\{2\times\pi\times f\times C271\times(R272+R273)\}^2\times R273/R273+R272 \tag{3}$$

In the Eq. (3), R272=the resistance value of the resistor 272; R273=resistance value of the resistor 273; C271= capacitance of the capacitor 271. The same rule applied in the later equations. Also, note that symbol f represents the frequency of the charging AC high voltage.

The voltage detecting circuit 202 detects the peak value of the differential waveform of the charging AC voltage waveform.

The charging output voltage is differentiated by the differentiating circuit, comprising the capacitor 275 and the resistor 276, and the differential voltage is inputted to the non-inversion terminal of the operational amplifier 278. Where the impedance of the capacitor 275 is set sufficiently larger than the impedance of the resistor 276, the AC voltage equivalent to the differential value of the charging AC voltage can be supplied to the input terminal of the operational amplifier 278 that constitutes the voltage follower. This AC voltage, passing through the operational amplifier 278, is converted to the DC voltage corresponding to the peak value of the differential value of the charging AC voltage by means of the peak hold circuit, and then is inputted, as the detect signal PRIDV, to the input terminal 245 of the CPU 245.

Figure 4C:
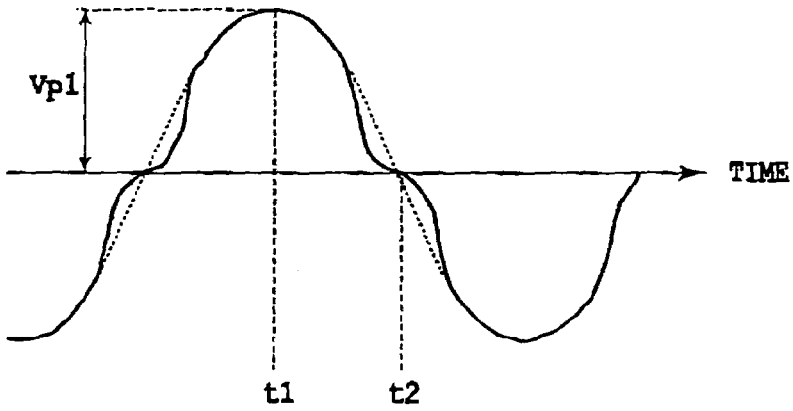

FIG. 4C shows the relationship between the charging AC waveform and the instantaneous voltage detect signal by the voltage detecting circuit 202. Further, FIG. 4C shows the differential waveform of the AC voltage waveform (FIG. 4B); in FIG. 4C, the time t1 is identical with the time t1 in FIG. 4A and FIG. 4B; the time t2 in FIG. 4C is identical with the time t2 in FIG. 4A and FIG. 4B. The broken line represents the form of the sine wave. In FIG. 4B, the waveform is distorted in the area near the peak thereof, while in the case of the waveform shown in FIG. 4C, the distortion ranges whole the sine wave. On the other hand, however, in the case of the waveform shown in FIG. 4C, the value of the portion being free of the distortion coincides with the value of Vp1 of the waveform of FIG. 4B. In other words, even when the charging AC waveform is distorted as in the case of FIG. 4B, the voltage detecting circuit 202 is capable of detecting the voltage identical with the value, Vp1, which is the value of the waveform being free of the distortion. Where the peak value of the differential value of the charging AC voltage is gives as Vp', the level of the detect signal PRIDVS of the voltage detecting circuit 202 can be given by the following expression.

$$PRIDVS=\phi\times Vp'-Vf \tag{4}$$

where Vf=voltage of the diode 284 descending in normal direction. ϕ is a value dependent on the resistor 276 and the capacitor 275 and can be given by the following expression.

$$\phi=2\times\pi\times f\times C275\times R276\times v(2\times\pi\times f\times C275\times R276)^2+1/1+(2\times\pi\times f\times C275\times R276)^2 \tag{5}$$

The values of the voltage detecting circuit 201 and the values of the resistors 273 and 276, and the capacitors 271 and 275, which constitute the voltage detecting circuit 201 and 202, are set so that the constant value ϕ and the constant value λ become equal to each other, thereby making sampling range of the sampling value PRIVS and the sampling range of the sampling value PRIDVS coincide with each other.

Next, the charging high voltage control process during the printing operation of the image forming apparatus according to the present embodiment will be described.

Figure 5:
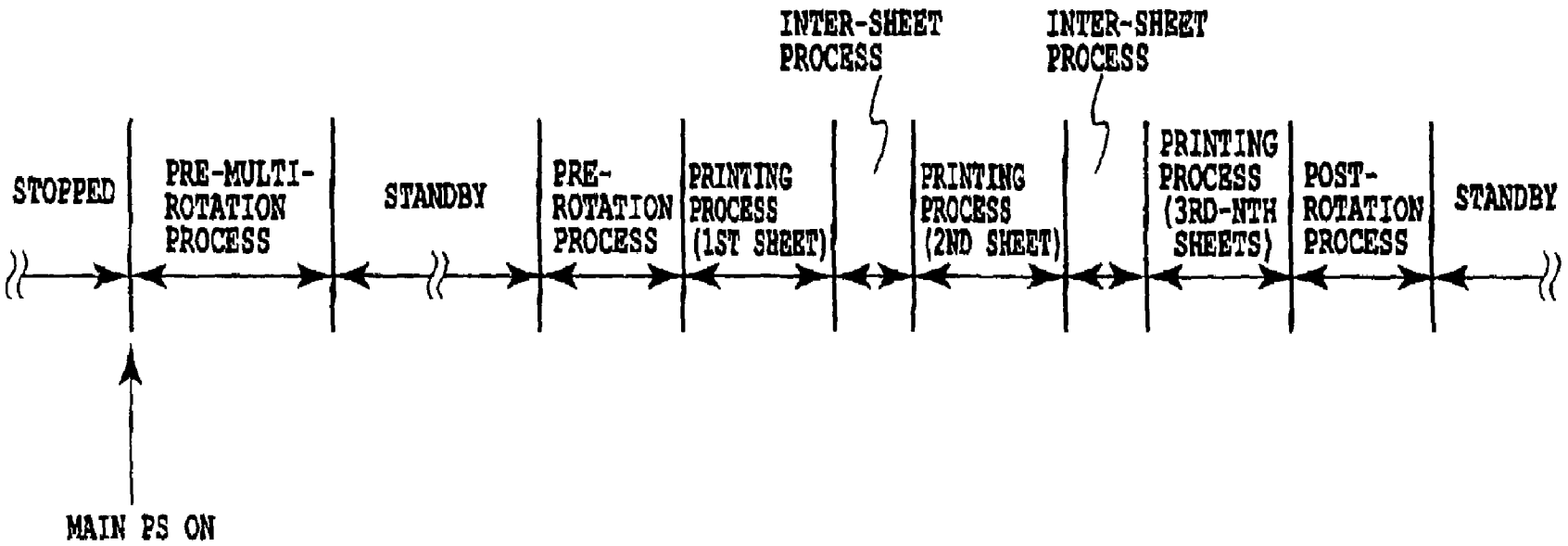
FIG. 5 is a sequence diagram of the printing operation in the first embodiment of the present invention.

FIG. 5 is a diagram representing the sequence of the printing operation of the present image forming apparatus When the main power source 100 of the apparatus is turned on, the fixing device executes the pre-multi-rotation process, i.e., a series of processes including the process for being warmed up to the predetermined temperature until reaching the standby state. Then, when the command for the start of the printing operation is received from an external apparatus 128 such as a personal computer, the image forming apparatus enters the pre-rotation process as the preparative step for the predetermined printing operation is carried out, and then enters the printing process for printing images on the printing sheets by means of a series of electro-photographic processes. When the image forming apparatus is set to the repetitive printing mode, the predetermined pre-printing processing preceding the printing of the next sheet is carried out before entering the printing process for the second printing sheet and on. After-the printing process for the last (Nth) sheet is completed, the image forming apparatus undergoes the backward rotation process and re-enters the standby state.

In the case of the image forming apparatus according to the present embodiment, the processing for determining the charging high AC voltage level is carried out during the pre-multi-rotation period and printing process or pre-printing process, and the result of such process is applied in controlling the charging high AC voltage during the printing operation.

Figure 6:
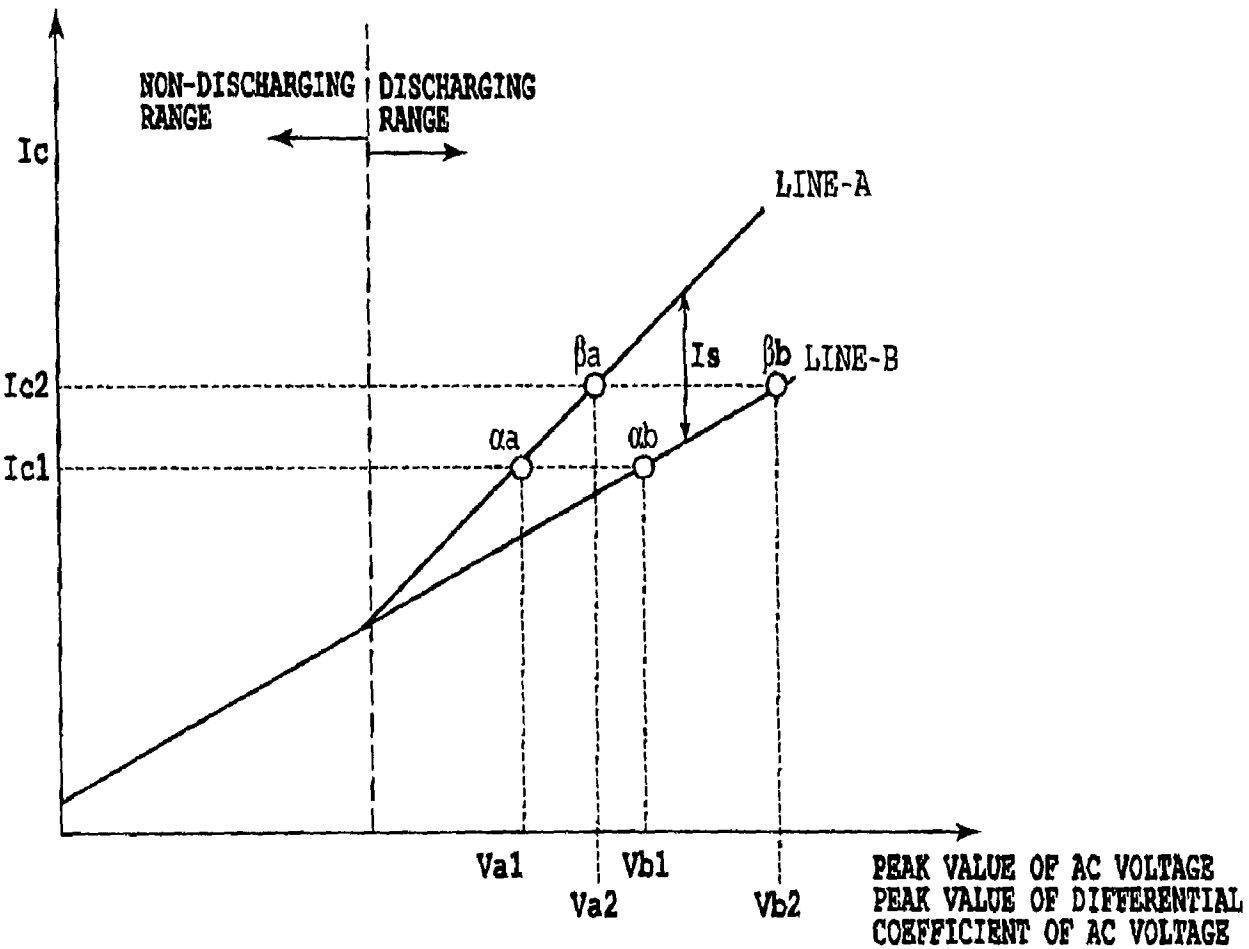
FIG. 6 is a diagram showing the characteristics of the charging AC voltage and the charging current in the first embodiment.

FIG. 6 represents the characteristics of the charging alternating current Ic (on y-axis), the peak value of the charging AC voltage and the peak value of the differential value of the charging AC voltage (x-axis) at the time when the charging high AC voltage is applied to the charge roller. In FIG. 6, the characteristic line, LINE-A, represents the peak value of the charging AC voltage and the characteristic of the charging alternating current, while the characteristic line, LINE-B, represents the peak value of the differential value of the charging alternating current and the characteristic of the charging alternating current. The charging alternating current Ic is given in terms of the average current value of the half-wave of the charging alternating current. The peak value of the charging AC voltage is sampled by the previously described voltage detecting circuit 201, while the peak value of the differential value of the charging AC voltage is sampled by the previously described voltage detecting circuit 202.

As the charging AC voltage to the charge roller is raised, both the charging alternating currents represented by the characteristic lines, LINE-A and the LINE-B, increase linearly in proportion to the two AC voltages. The area (defined by the LINE-A and the LINE-B) corresponds to an area being free of discharging (non-discharging area), wherein only the nip current flows according to the resistive load and the capacitive load between the charge roller and the photoconductor drum. If the AC voltage is raised further, the area (defined by the LINE-A and The-LINE-B) becomes the discharging area (discharge producing area) to cause the charging current, composed of the sum of the nip current and the discharging current, to flow.

On the boundary between the non-discharging area and the discharging area, the value of the charging current is discontinuous and varies almost linearly with respect to the AC high voltage level within respective areas. On the other hand, the characteristic line, LINE-B, varies continuously and linearly within both the areas with respect to the high AC voltage level, irrespective of the presence or absence of the discharging. The difference in the characteristic between the characteristic line, LINE-A, and the characteristic line, LINE-B, results from the distortion of the waveform of the charging AC voltage occurring with the start of the discharge. When the charging AC voltage exceeds the charging start voltage, the discharge occurs at the time when the peak of the AC voltage nears to cause the discharge current to flow. The discharge current rises abruptly to flow instantaneously.

When the discharge current flows in the high-voltage transformer 204 provided for generating the charging AC voltage, the voltage drop occurs between the output terminals of the high-voltage transformer 204 owing to the effect of the leakage inductance of the high-voltage transformer 204, causing the distortion of the output voltage waveform. In this case, the waveform is as given in FIG. 4B. The distortion occurred to the charging AC voltage causes the difference in the peak value between the charging AC voltage and the differential value of the charging AC voltage and the resulting difference between the characteristic lines, LINE-A and LINE-B.

Irrespective of the presence or the absence of the discharge, the characteristic represented by the characteristic line, LINE-B, varies linearly to the level of the high AC voltage and presents a linear characteristic similar to the characteristic of the nip current and according to the resistive load and the capacitive load between the charge roller and the photoconductor drum, except the case of the discharging current. Hence, as in FIG. 6, the difference between the characteristic line, LINE-A, and the characteristic line, LINE-B, corresponds to the discharging current Is.

In the process of the charging high voltage control according to the present embodiment, the two characteristics represented by the characteristic lines, LINE-A, and the characteristic line, LINE-B, are sampled respectively as the bases whereon the charging current Ic, with which the predetermined value of the charging current can be obtained, is calculated, and, on the basis of the result of this calculation, the charging high AC voltage is controlled during the printing operation. In calculating the line characteristics, the characteristic represented by the characteristic line, LINE-A, is calculated by the samplings at the points αa and βa, while the characteristic represented by the characteristic line, LINE-B, is calculated by the sampling at the points αb and αb. All these 4 points are to be set within the area where the discharge occurs. A series of processes for determining the level of the charging high AC voltage level will be described in the following.

(1) Process during Pre-Rotation Period

Figure 7:
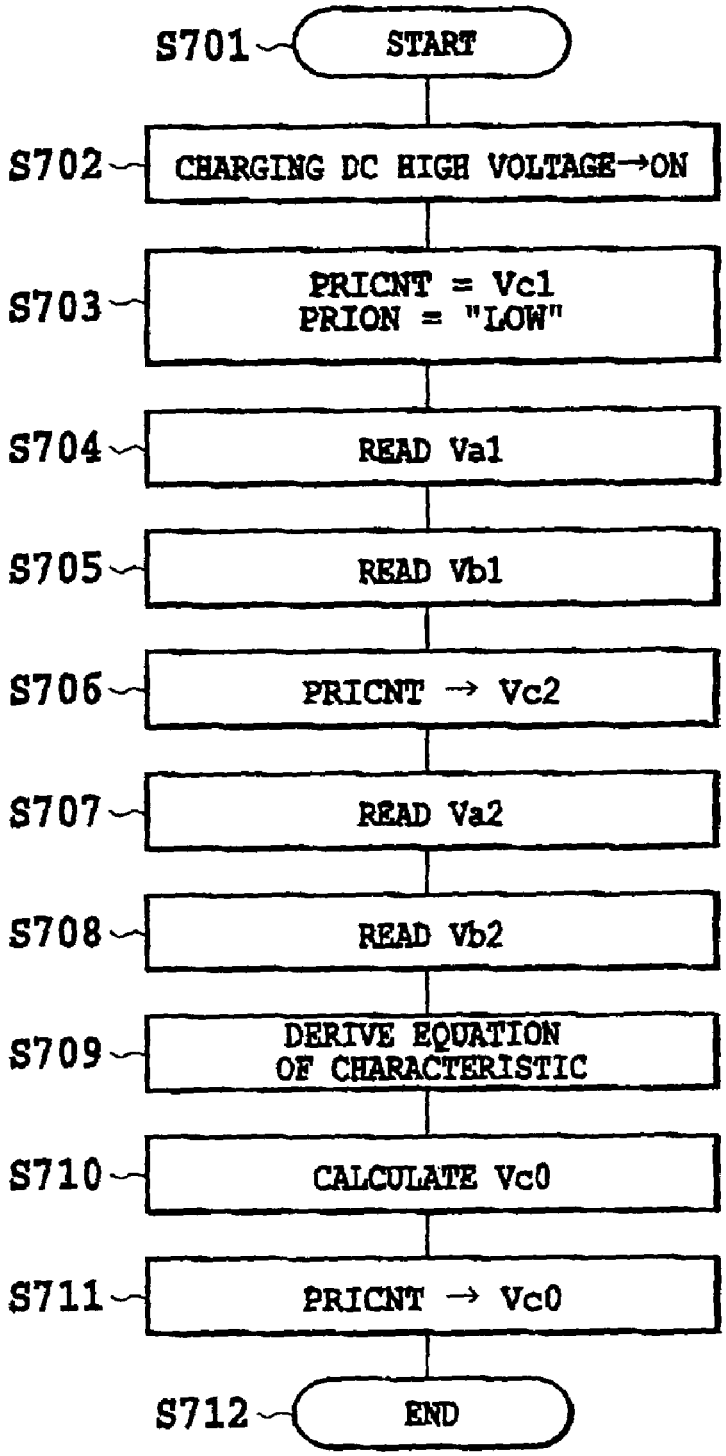
FIG. 7 is a flowchart of the pre-rotation process in the first embodiment.

Prior to the shift of the process of the image forming apparatus from the standby state to the printing process, the level of the charging high AC voltage is determined during the pre-rotation process. The series of the processes during the pre-rotation period will be described referring to FIG. 7.

Figure 8A:
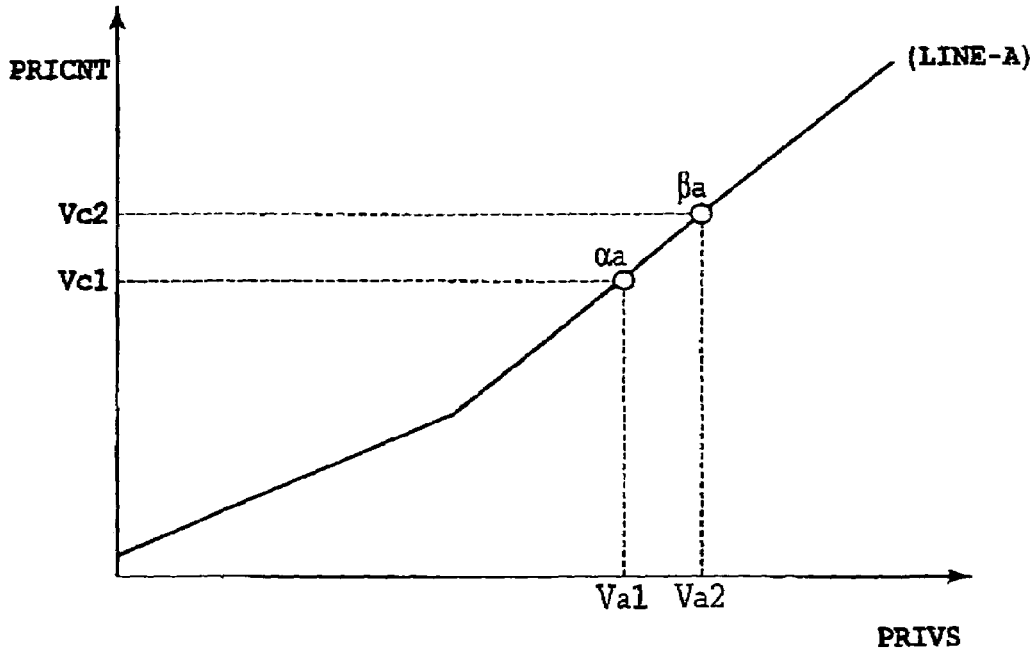
FIG. 8A and FIG. 8B are the diagrams showing the characteristic of the detect signal in the pre-rotation process of the first embodiment.
Figure 8B:
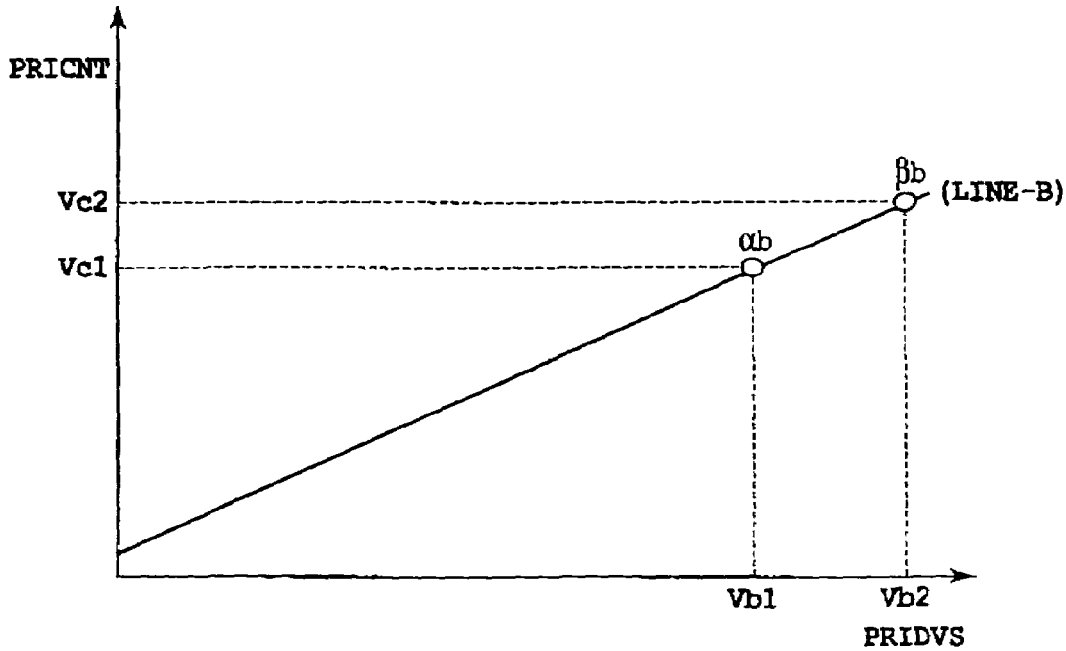

In the step S702, the charging high DC voltage in the high DC voltage generating circuit 247 is turned on. Then, the samplings are made at the four points at the steps S703 through S708. FIG. 8A and FIG. 8B show the sampling points respectively. In FIG. 5A and FIG. 8B, the points αa, βa, αb and βb correspond to the points αa, βa, αb and βb in FIG. 6 respectively.

First, the samplings are made at the points αa and αb at the steps S703 through S705. In the step S703, the current control signal PRICNT (on the y-axis) is set to Vc1, and the charging AC voltage drive signal PRION is set to the LOW level to output the charging AC voltage. Subsequently, at the step S704, the sampling value PRIVS (on the x-axis in FIG. 8A) sampled by the voltage detecting circuit 201 is read. In this process, the inputted value is represented by Va1. Further, at the step S705, the instantaneous voltage detect signal PRIS (on the x-axis in FIG. 8B) is sampled by the voltage detecting circuit 202. In this process, the read value is represented by Vb1.

In the steps S706 through S708, the samplings are made at the points βa and βb. In the step S706, the setting of the current control signal PRICNT is altered from Vc1 to Vc2 to alter the output level of the charging AC voltage. In the step S707, the sampled value PRIVS sampled by the voltage detecting circuit 201 is read. In this process, the read value is Va2. In the step S708, only the instantaneous voltage detect signal PRIDVS sampled by the voltage detecting circuit 202 is read. In this process, the read value is Vb2.

Subsequently, the characteristics of the characteristic lines, LINE-A and LINE-B, are calculated at the previously used 4 points (S709). Assuming that the characteristics represented by the characteristic lines, LINE-A and the LINE-B, can be approximated respectively by the linear equations as are given below, the constants α, β, γ and θ are calculated with respect to the 4 sampling points.

$$PRICNT=\alpha\times PRIVS+\beta \tag{6}$$

$$PRICNT=\gamma\times PRIDVS+\theta \tag{7}$$

Next, the value, Vc0, of the current control signal PRICNT is calculated by using the above Eqs. (6) and (7) (S710). As discussed previously, the difference between the characteristic lines, i.e., LINE-A and LINE-B, corresponds to the discharging current. Assuming that the amplitude (range) of the current control signal PRICNT is ΔVc, Vc0 can be expressed by the following equation.

$$Vc0=\Delta Vc/\alpha-\gamma+\alpha\times\theta-\beta\times\gamma/\alpha-\gamma \quad (8)$$

In this case, the amplitude (range) ΔVc of the current control signal PRICNT corresponding to the predetermined discharging current value is previously stored in the ROM245b of the CPU245. Subsequently, at step S711, the current control signal PRICNT is set to the Vc0, calculated at the step S710, while the charging AC voltage is set to the value for the printing operation, to complete the series of processes. When these processes are completed, the processing enters the process for the printing of the first sheet.

(2) Process in Printing

Described in the forgoing is concerned with the processing starting from the standby state to the process for determining the charging high AC voltage level that is required for starting the printing operation for the printing of the first sheet. In the image forming apparatus according to the present embodiment, in carrying out the continuous printing, even after entering the printing process, the processing for determining the high AC charging voltage level is repeated so that the setting of the AC voltage level can be corrected according to the result of the processing. This processing is made each time when the continuous printing of 50 sheets is finished starting from the standby state. The necessity of this processing is determined on the basis of the count made by the counter for counting the number of printed sheets incorporated into the CPU245.

Figure 10:
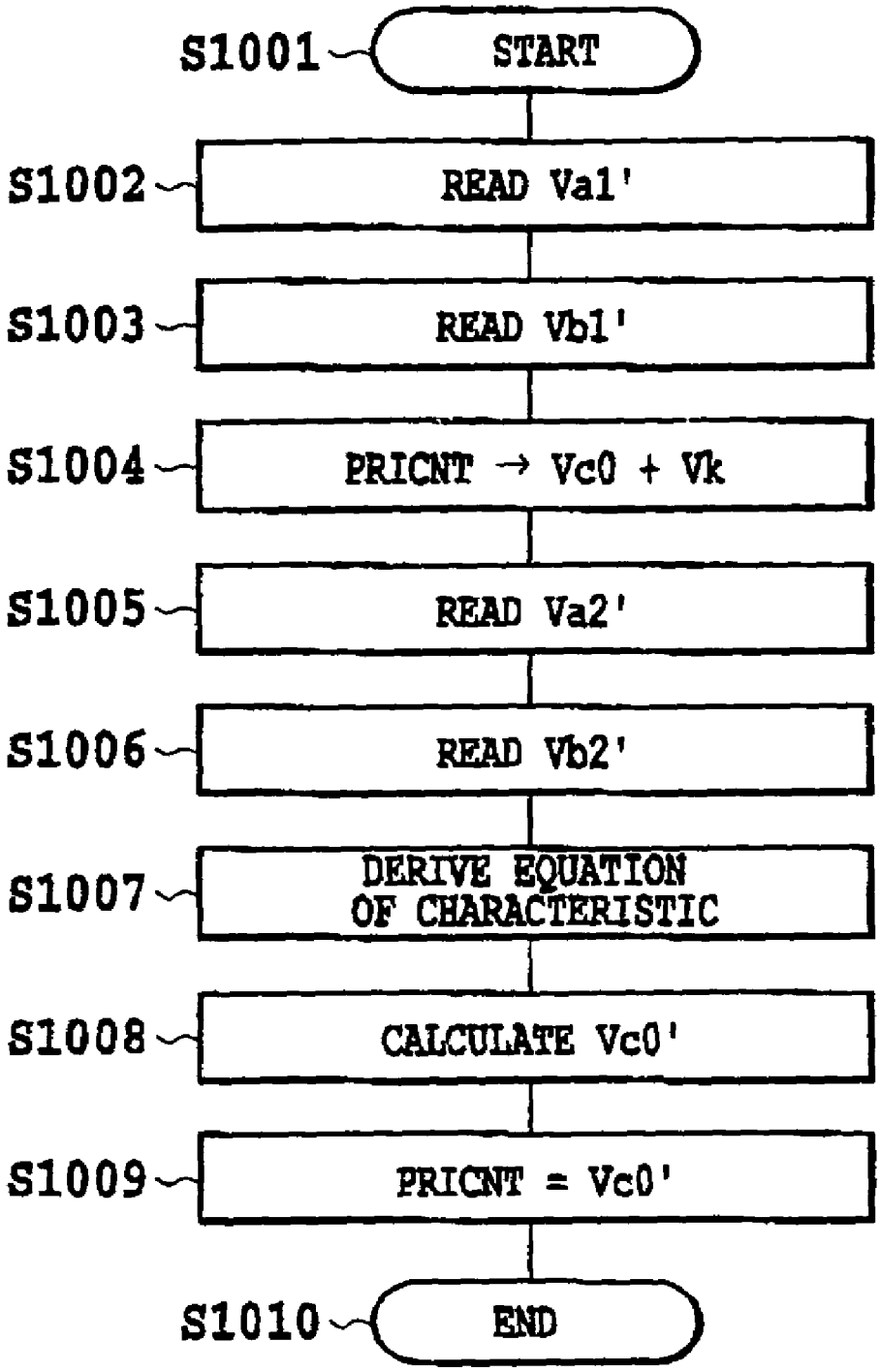
FIG. 10 is a flowchart of the printing process of the first embodiment.

The corrective processing for the high AC charging voltage level during the period of the printing process will be described referring to FIG. 10. For the corrective processing, similarly to the case of the corrective processing during the previously mentioned pre-rotation process period, the sampling is made at the 4 points to re-detect the characteristics represented by the LINE-A and the LINE-B to thereby calculate the value of the current control signal PRICNT at which the value of the current for discharging coincides with the predetermined value.

Figure 9A:
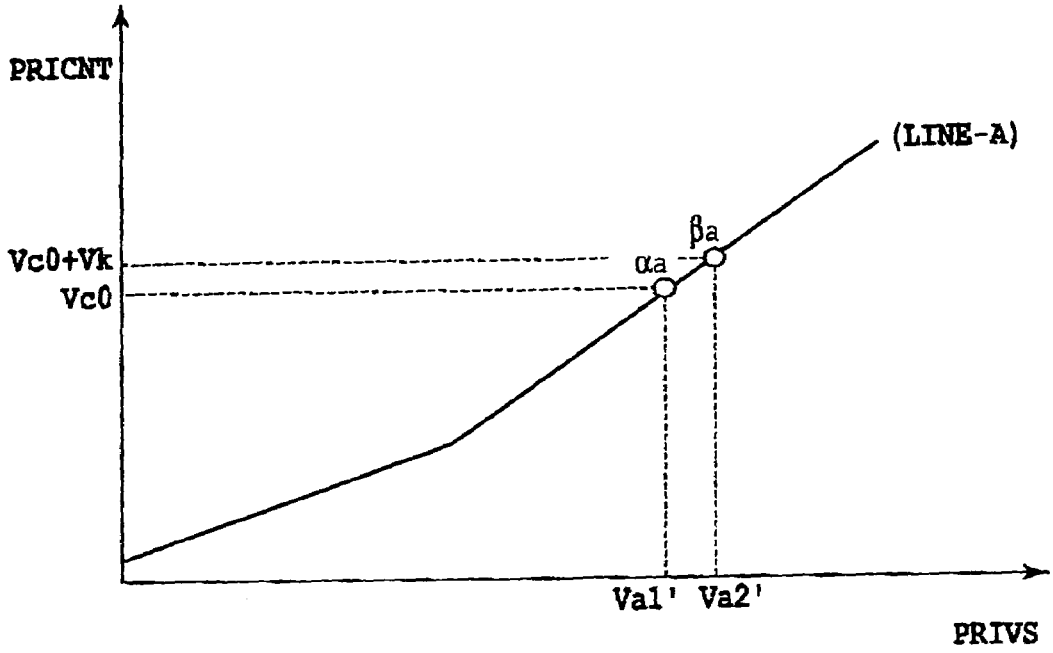
FIG. 9A and FIG. 9B are the diagrams showing the characteristics of the detect signals for the printing process of the first embodiment.
Figure 9B:
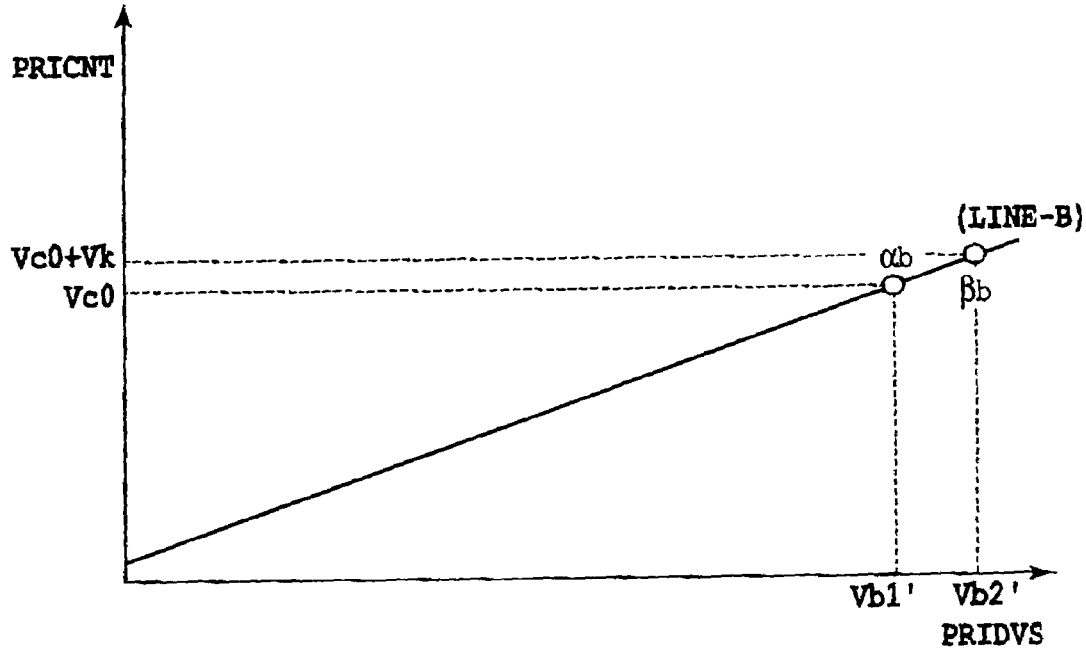

FIG. 9A and FIG. 9B are the diagrams showing the sampling points on the characteristic lines, LINE-A and LINE-B. First, at the steps S1002 and S1003, the current control signal PRICNT (on the y-axis) is set to the present value Vc0 to make the sampling. In this case, the present value Vc0 means the set value calculated in the process for determining the AC voltage level, which has been carried out immediately before carrying out the present processes. The value PRIVS (on the x-axis in FIG. 9A) sampled by the voltage detecting circuit 201 and the value PRIDVS (on the x-axis in FIG. 9B) sampled by the voltage detecting circuit 202. These values are read as Va1' and Vb1' respectively.

Subsequently, at steps S1004 through S1006, the value of the current control signal PRICNT is increased by Vk to Vc0 before carrying out the sampling. In other words, the sampling is made in the state where AC charging voltage is set higher than the present value. The value PRIVS sampled by the voltage detecting circuit 201 and the value PRIDVS sampled by the voltage detecting circuit 202 are read respectively as Va2' and Vb2'.

The reason for that the current control signal PRICNT is sampled at the point where the value of the charging current is higher than the present value Vc0 is to prevent the occurrence of the poor image owing to the change in the level of the AC charging voltage by raising the level of the charging current on the photoconductor drum. If the sampling is made at the point where the value of the charging current is lower than the present value Vc0, there is the possibility that the charge on the photoconductor drum becomes too low to cause the formation of the poor image.

Subsequently, similarly to the processing carried out in the pre-rotation process, the characteristics of the characteristic lines, LINE-A and LINE-B, are calculated (S1007), and the value Vc0 of the current control signal PRICNT is calculated (S100B) to thereby obtain the value coinciding with the predetermined value of the current for discharging. Subsequently, at step S1009, the setting of the current control signal PRICNT is altered from Vc0 to Vc0' to alter the output level of the AC charging voltage thereby completing a series of processes. After completing the necessary processes, the counter for counting the number of the printed sheets is reset, and the same processes are repeated from the point at which the printing of 50 sheets is completed.

As described in the foregoing, in the control of the high charging voltage according to the present embodiment, the peak value of the differential value of the AC charging voltage is measured, and the nip current is sampled by using the measured value of the AC charging voltage. By employing such composition for the system, it becomes possible to sample the nip current within the discharging range, thereby enabling the level of the current for discharging to be controlled with high accuracy. In this way, it becomes possible to obtain a uniform charge without giving rise to a problem such as the deterioration of the photoconductor drum or the formation of poor image, irrespective of the variation of the characteristic of the charging member during the manufacturing process or the change in environmental condition. Further, at the time of the continuous printing operation, it becomes possible to reset the level of the current for discharging without causing the level of the charging current to become lower than the present level, and also, at the time of the continuous printing operation, it becomes possible to obtain a uniform charge without causing the deterioration of the photoconductor drum or the formation of poor image, irrespective of the change in the environmental condition or the variation of the characteristic of the charging member occurring during the manufacturing process.

(The Second Embodiment)

The second embodiment of the present invention will be described in the following. In the first embodiment, the nip current is sampled by sampling the peak value of the differential value of the AC charging voltage. In the second embodiment, however, the nip current is sampled on the basis of the phase deviation in the predetermined phase interval.

Figure 11:
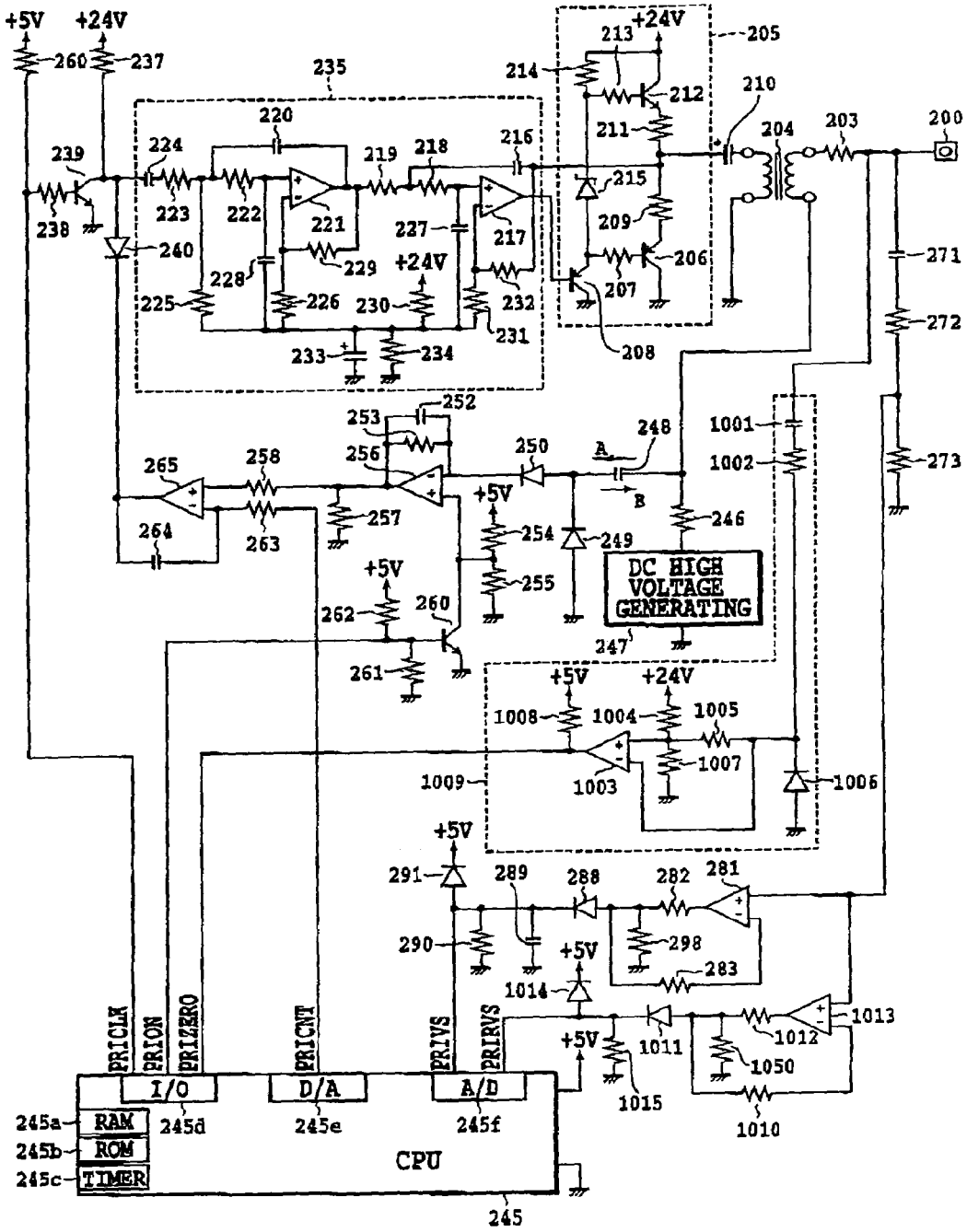
FIG. 11 is a circuit diagram showing the charging high-voltage output circuit of the image forming apparatus as the second embodiment of the present invention.

FIG. 11 is the charging high-voltage output circuit in the image forming apparatus as the second embodiment, and the basic composition the circuit is similar to the circuit of the first embodiment.

The second embodiment differs from the first embodiment in that the voltage detecting circuit 202, as being the differential voltage detecting circuit which is found in the first embodiment, is not provided, that a zero crossing detecting circuit 1009 for sampling the zero crossing point, at which the witching between the positive polarity and the negative polarity of the alternating current waveform takes place, is provided, and that a circuit for sampling the instantaneous value of the AC charging voltage is provided.

The AC charging voltage is connected with a comparator 1003 through a capacitor 1001 and resistors 1002, 1005, 1004 and 1007. The capacitance of the capacitor 1001 is set to a value so that the impedance becomes sufficiently low to the combined resistance of the resistors 1002, 1004, 1005 and 1007. Hence, the phase shift at the two ends of the capacitor 1001 is (relatively) small, so that, for the non-inverted input and the inverted input to the comparator 1300, the AC signal having the phase which is identical with the output terminal is inputted. When the AC charging voltage has a positive polarity, the potentiality of the inverted input to the comparator 1003 becomes equal to or higher than the potentiality of the non-inverted input to make the output 0V, whereas when the same has a negative potentiality, the potentiality of the inverted input to the comparator 1003 becomes lower than the non-inverted input to make the output 5V.

A diode 1006 prevents the potentiality of the comparator 1003 from becoming lower than the predetermined potentiality. The output of the comparator 1003, as being the detect signal PRIZERO of the zero crossing detecting circuit 1009, is connected with CPU245. The sampled signal PRIZERO is inputted to the external interruption terminal of the I/O port of the CPU 245 where the interruption occurs at the falling edge of the input signal.

Figure 12:
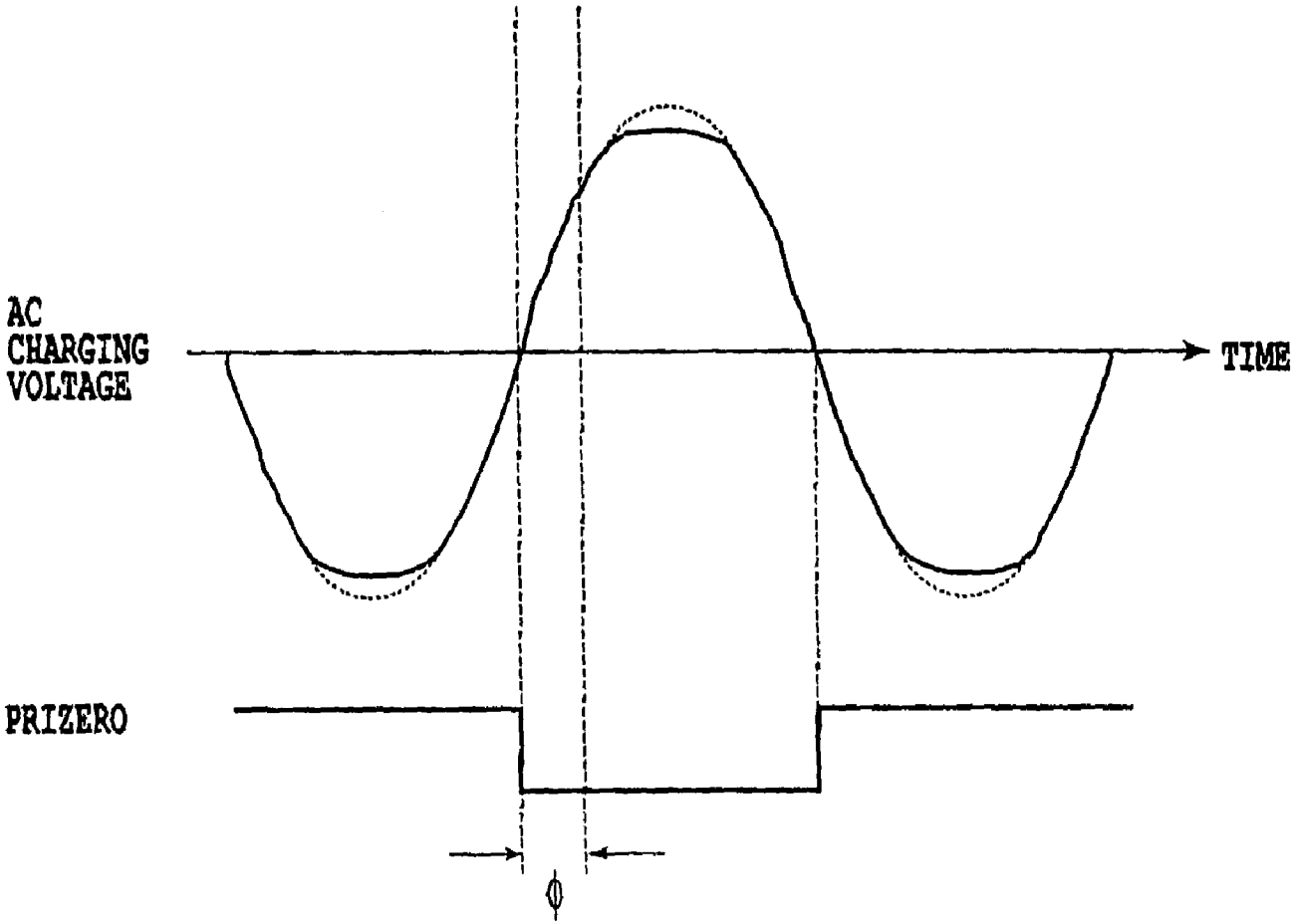
FIG. 12 and FIG. 13 are the circuit diagrams showing the zero crossing signal in the second embodiment.

FIG. 12 is a timing chart representing the waveform of the AC charging voltage and the zero crossing detect signal PRIZERO. At the time point where AC charging voltage has a negative polarity, the voltage of the zero crossing detect signal PRIZERO becomes 5V which corresponds to the HIGH level of the CPU245. At the time point when the polarity of the AC charging voltage is switched from a negative polarity to a positive polarity, the voltage of the zero crossing detect signal PRIZERO is switched to 0V. In other words, the system is in a state so that the zero crossing timing of the AC charging voltage can be read by the CPU 245. Further, the internal timer of the CPU 245 is used to sample the timing after laps of the predetermined time length $\phi$ from the timing for the fall of the zero crossing detect signal PRIZERO.

In the image forming apparatus according to the second embodiment, the time $\phi t$ corresponding to the time, at which the AC charging voltage is equivalent to 30 deg. from the phase of the AC charging voltage circuit, is sampled to sample the level Vt of the AC charging voltage at that time. The magnitude of the $\phi t$ is to be set so that the distortion will not occur within the range of the $\phi t$ in consideration of the magnitude of the distortion that can cause the distortion of the waveform of the AC charging voltage.

$\phi t$ can be expressed by the following equation where the frequency is given as f.

$$\phi=1/f\times 30/360 \tag{9}$$

Further, Vt is sampled by means of the instantaneous voltage detect signal PRIDVS to be inputted to A/D input port 245*f* of the CPU 245.

The instantaneous voltage detect signal PIRVS is a signal corresponding to the instantaneous value of the AC charging voltage and is obtained by converting the AC charging voltage, which has been divided by means of the capacitor 271, the resistor 272 and the resistor 273, through a voltage follower, comprising an operational amplifier 1013, and a diode 1011. The diode 1011, having a characteristic identical with the characteristic of a diode 288 in the voltage detecting circuit 201, is used so that the instantaneous voltage detect signal PRIVS and the detect signal PRIVS, to be applied to the voltage detecting circuit 201 have identical sampling ranges.

Figure 13:
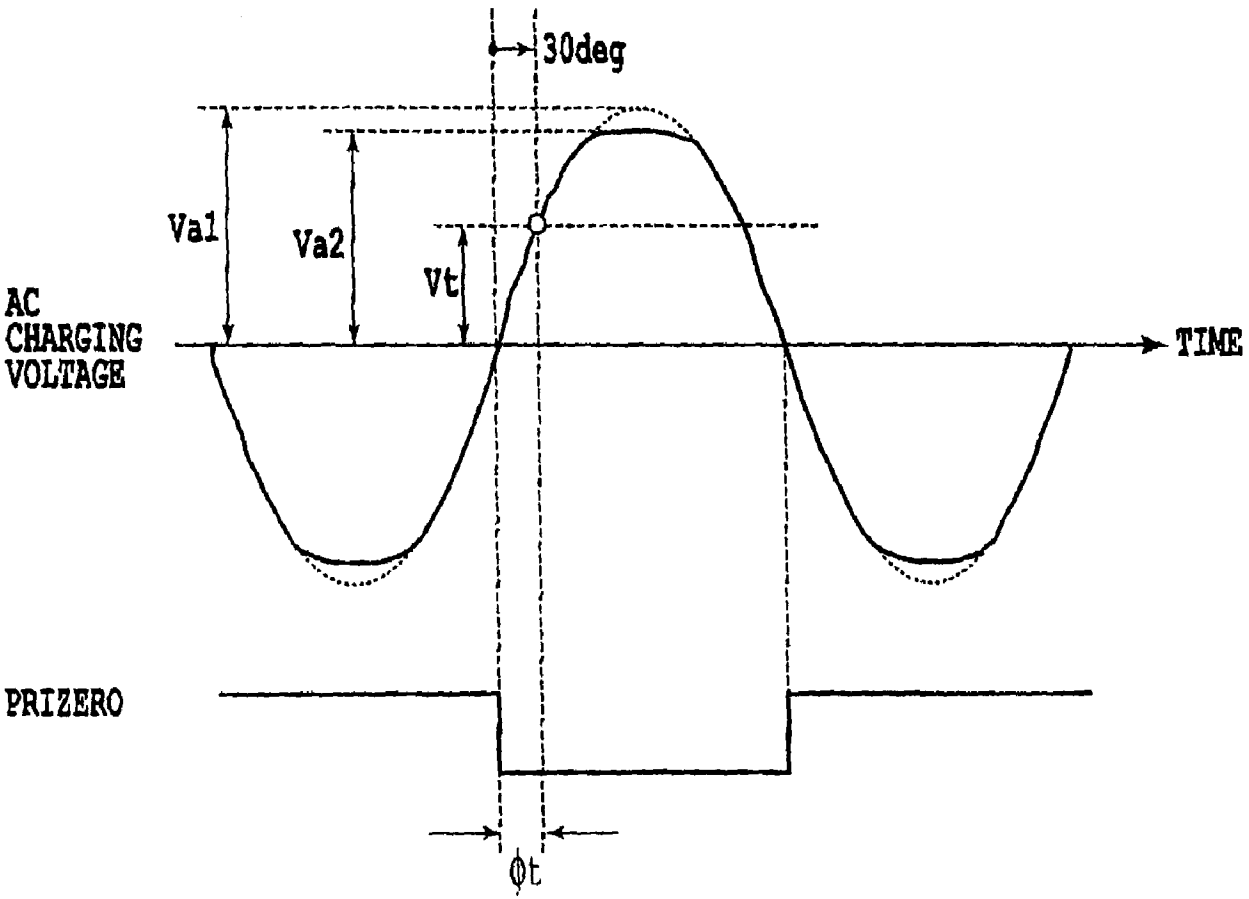

The relationship between the AC charging voltage waveforms $\phi t$ and Vt is shown in FIG. 13. In FIG. 13, the broken line is a sine wave whose peak value is Va1. Similarly to the case in the first embodiment, the portion near the peak of the wave is distorted to make peak value Va2 thereof lower than the peak value Va1. However, the distortion of the waveform is not present within the range of $\phi$1. Since $\phi t$ is the timing of the sine wave at the point of 30 deg, the relationship between the voltage at 30 deg. and the peak value Va1 of the sine wave can be expressed by the following equation.

$$Vt=\mathrm{SIN}(30\ \mathrm{deg.})\times Va1=0.5\times Va1 \tag{10}$$

That is, the double value of the voltage level Vt at the timing of $\phi t$ becomes the peak value Va1 of the sine wave.

Since the characteristic of the peak value of the sine wave and the characteristic of the alternating charging current are identical with the characteristic of the characteristic line, LINE-B, in FIG. 6 of the first embodiment, the nip current can be measured by using the double value of the Vt. In controlling the alternating charging current in the second embodiment, the Vt is measured; the characteristic of the nip current is measured on the basis of the double value of the Vt; and the value of the current for discharging is controlled to the predetermined value according to the steps similar to those in the case of the first embodiment.

Figure 14A:
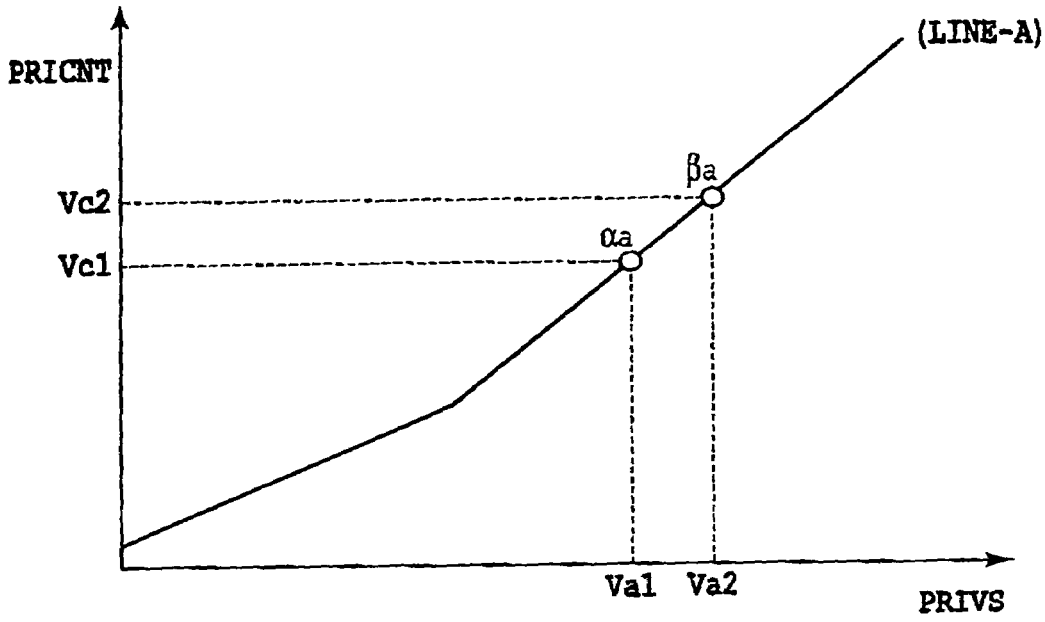
FIGS. 14A and 14B are the diagrams showing the characteristics of the detect signals in the first embodiment.
Figure 14B:
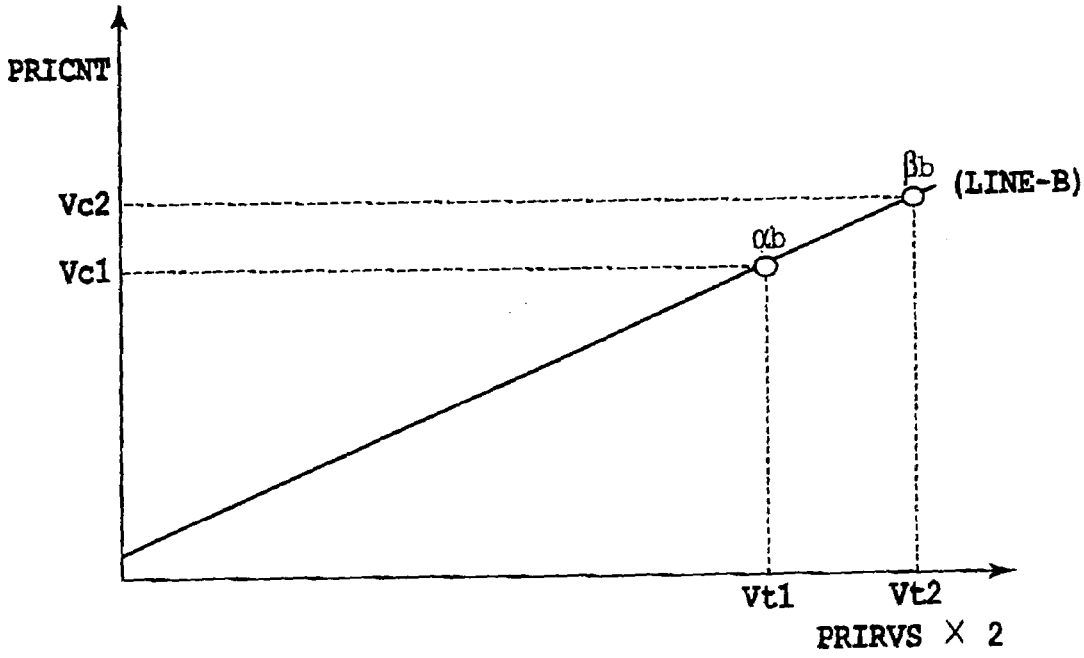

Next, a series of steps for determining the high AC charging voltage level the pre-rotation stage in the second embodiment are shown in FIG. 14A and FIG. 14B. The basic steps corresponding to the series of the processes are similar to those of the first embodiment but differ only in the sampling process of the characteristic line, LINE-B.

Figure 15:
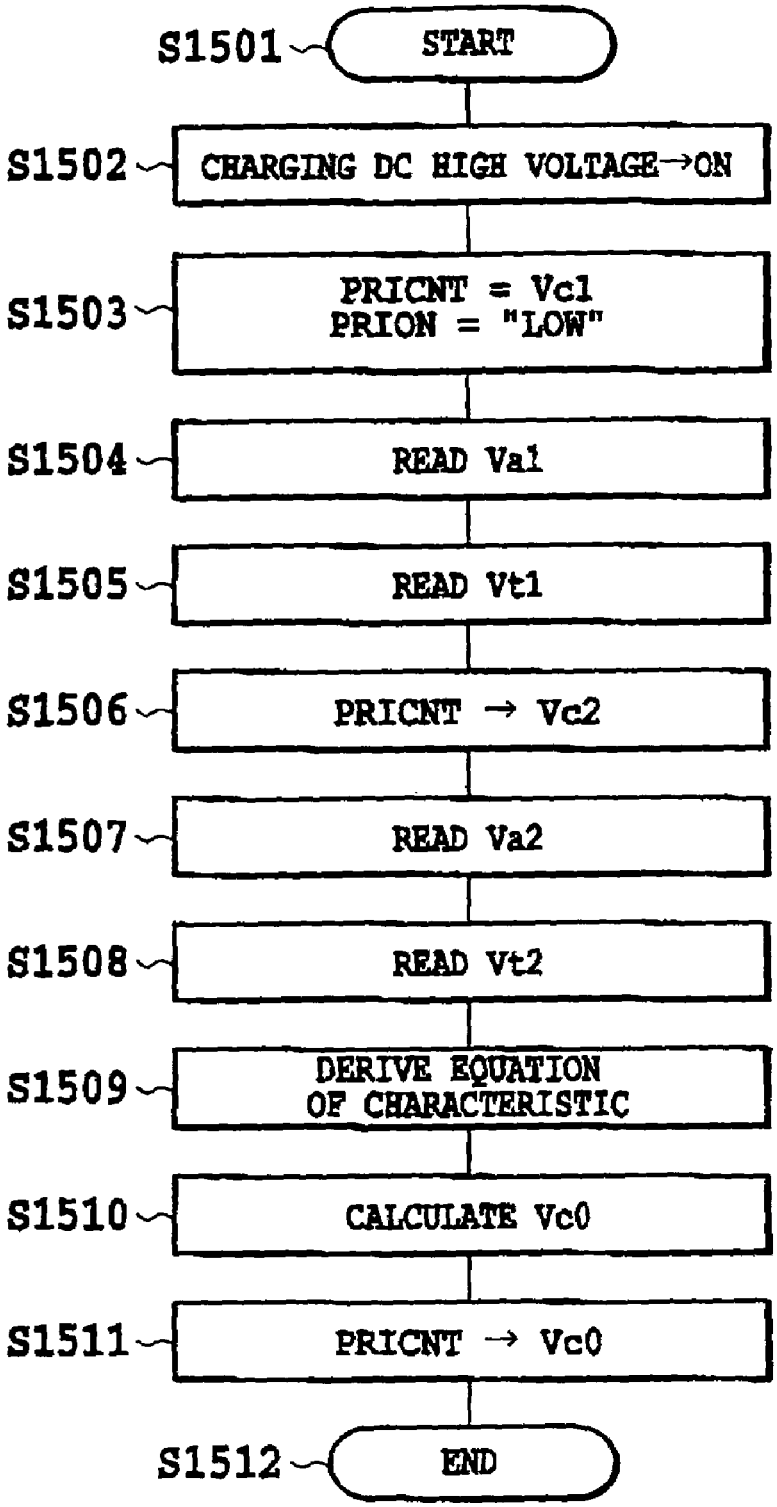
FIG. 15 is a processing flowchart of the second embodiment.

In FIG. 15, the bias of the direct charging current is turned on, and then the samplings are made at 4 points, i.e., $\alpha$a, $\alpha$b, $\beta$a and $\beta$b shown in FIG. 6. FIG. 14A shows the characteristics of the detect signal PRIVS (on x-axis) and the charging current control signal PRICNT (on y-axis), while FIG. 14B shows the characteristics of the PRIRVS×2 (on the x-axis), the double value of the instantaneous voltage detect signal PRIRVS, and the current control signal PRICNT (on the x-axis).

First, the samplings at the points, $\alpha$a and $\alpha$b, are made at the steps, S1503 through S1505. In step S1503, the current control signal PRICNT is set to Vc1, and the charging AC voltage drive signal PRION is set to LOW level to output the charging AC voltage. Subsequently, at step S1504, the value PRIVS sampled by the voltage detecting circuit 201 is read. In this case, the value to be read is Va1. Further, at step 1505, the instantaneous voltage detect signal PRIRVS is read, and the double value thereof is set to Vt1.

In the steps S1506 through S1408, the samplings are made at the points, $\beta$a and $\beta$b. In the step S1506, the set value of the current control signal PRICNT is altered from Vc1 to Vc2 to alter the output level of the AC charging voltage. In the step S1507, the value of PRIVS sampled by the voltage detecting circuit 201 is read. In this case, the value to be read is Va2. In the step S1508, the sampled instantaneous voltage signal PRIRVS is read, and the double value of the read value is set as Vt2.

Subsequently, the processing proceeds to step 1509 to calculates the characteristics of the characteristic lines, LINE-A and LINE-B, by using the 4 points at which the samplings have been made according to the previously described processes. Assuming that the characteristic lines, LINE-A and LINE-B, can be approximated by the linear equations as are given below respectively, the constants, $\alpha$, $\beta$, $\gamma$ and $\theta$ are calculated on the bases of the four sampling points.

$$PRICNT=\alpha\times PRIVS+\beta \tag{11}$$

$$PRICNT=(PRIRVS\times 2)+\theta \tag{12}$$

Next, from the Eqs. (11) and (12), the Vc0, the value of the current control signal PRICNT, with which the discharging current value coincides with predetermined value (S2610).

Similarly to the case of the first embodiment, where the range of the current control signal PRICNT, corresponding to the predetermined discharging current, is given as ΔVc, the Vc0 can be expressed by the following equation.

$$Vc0=\Delta Vc/\alpha-\gamma+\alpha\times\theta-\beta\times\gamma/\alpha-\gamma \quad (13)$$

Subsequently, at the step S1511, the current control signal PRICNT is set to Vc0, which has been calculated at the step S1510, to thereby set the AC charging voltage to the value for the printing operation to finish a series of processes. After completing these processes, the processing proceeds to the printing process for the first sheet. Further, previously, the example of the application of the processing (in the case of the first embodiment) to the processing during the pre-rotation process; however, the processing during the printing operation process in the case of the first embodiment can also be applied to the processing in the present embodiment.

As described in the foregoing, in the case of the control of the high-voltage for charging according to the second embodiment, the deviation of the AC voltage-in the predetermined section is measured so that the measured deviation value can be applied in sampling the nip current. With the system composed in this way, it becomes possible to sample the nip current within the range wherein the discharge occurs to thereby making it possible to control the discharging current with high accuracy. Hence, irrespective of the variation of the environmental condition or the variation of the characteristic of the charging member occurred during the manufacturing process, it becomes possible to obtain a uniform charge without giving rise to the problems such as the deterioration of the photoconductor drum or the poor image formation. Furthermore, in the continuous printing operation, it becomes possible to reset the magnitude of the discharging current to prevent the magnitude of the charging current from falling below the level of the present charging current, whereby a uniform charge can be obtained without entailing the problems such as the deterioration of the photoconductor drum or poor image formation while being free of the variation of the environmental condition or the variation in the characteristic of the charging member owing to the manufacturing process.

(The Third Embodiment)

Figure 16A:
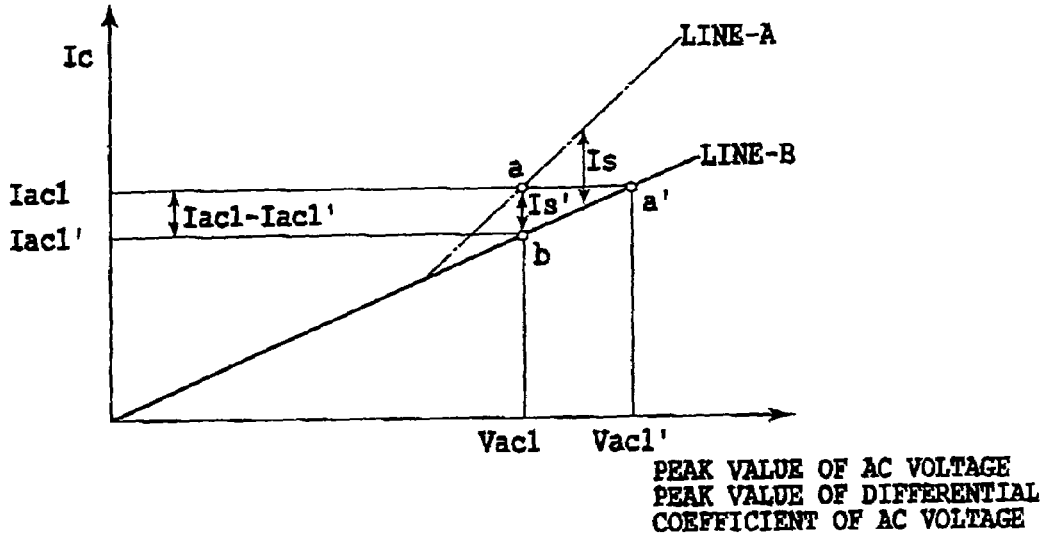
FIGS. 16A and 16B are diagrams showing the characteristics of the detect signals for the pre-rotation process of the third embodiment.

FIG. 16A shows the relationship among the peak value of the AC charging voltage, the peak value (on the x-axis) of the differential value of the AC charging voltage and the charging current Ic (the y-axis). The process of the charging high voltage control will be described referring to FIG. 16A. In the present embodiment, in order for the high charging voltage to be controlled to the predetermined value, Iac1, the charging AC voltage is applied accordingly, and the processing as is described in the following are executed.

First, the peak value Vac1, corresponding to the intersecting point a between the characteristic line, LINE-A, (representing the peak value of the charging AC voltage) and the straight line, including the point of the peak value Vac1 of the AC charging voltage, is sampled by the voltage detecting circuit 201, while the peak value Vac1' of the differential value of the AC value for charging, corresponding to the intersecting point a' between the characteristic line, LINE-B, (representing the peak value of the differential value of the AC charging voltage) and the straight line, including the point at which the charging current becomes Iac1, is sampled by the voltage detecting circuit 202 Next, the charging current Ic is varied until the sampled value Vac1' sampled by the voltage detection circuit 202 becomes equal to the initial sampled value Vac1 by the voltage detecting circuit 201.

Then, the charging current Iac1, at which the level of the actual charging current Is' coincides with the predetermined charging current Is, is calculated so that the high AC charging voltage during the printing operation can be controlled on the basis of the Iac1; the Is' is the value corresponding to the difference between the value of the intersecting point, a, between the straight line, representing the charging current Iac1, and the characteristic line, LINE-A, and the value of the intersecting point, b, between the straight line, representing the charging current Iac1' and-the characteristic line, LINE-B. All these three points, a, a' and b, are set within the range of charging. A series of processes for determining the AC high charging voltage level will be described in detail in the following.

(1) Process during Pre-rotation Period

Figure 17:
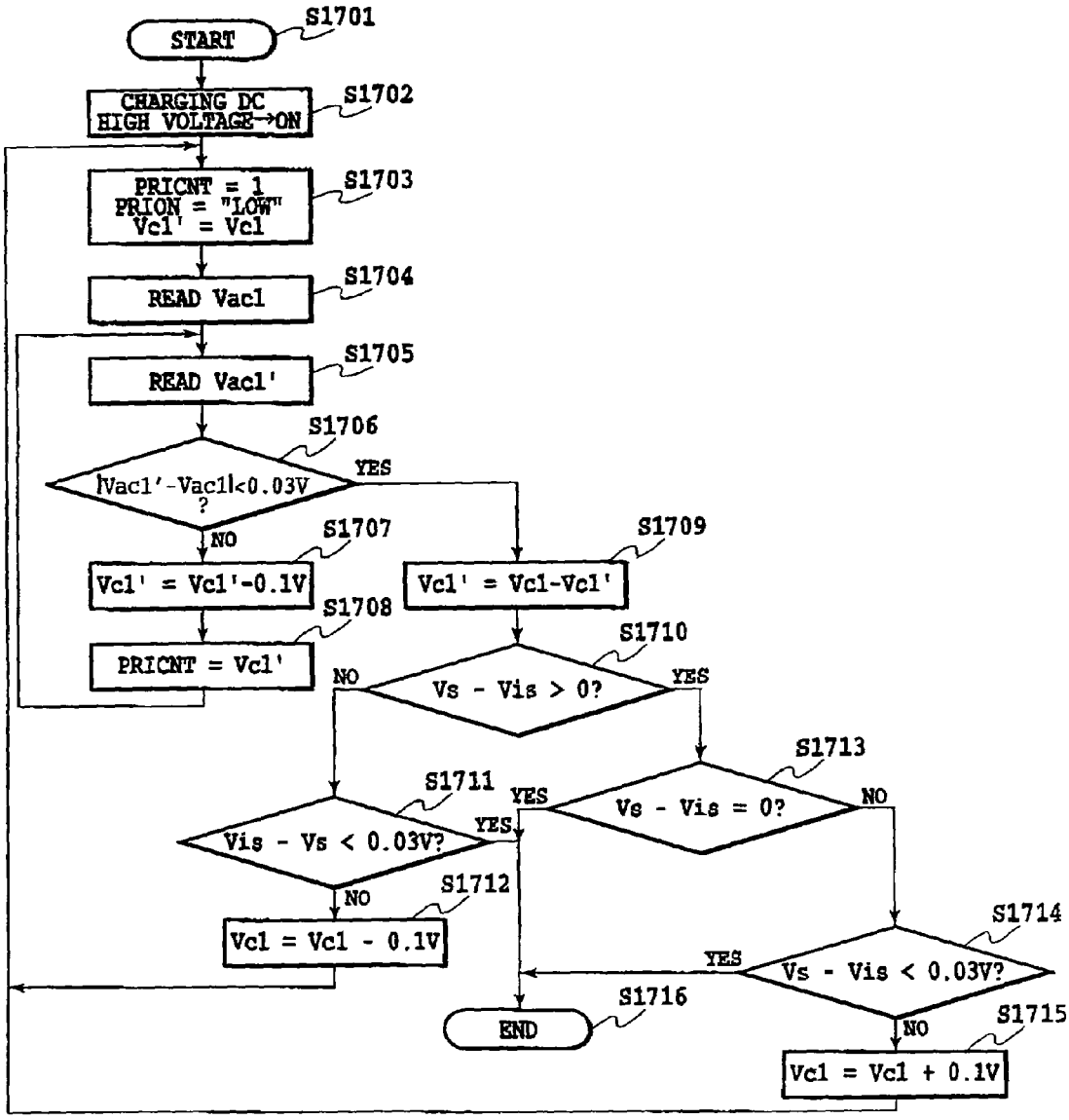
FIG. 17 is a flowchart of the pre-rotation process of the third embodiment.

When the operation of the image forming apparatus proceeds to the printing process from the standby state, the processing for determining the level of AC high charging voltage will be made during the pre-rotation period. The series of processes during the pre-rotation period will be described referring to FIG. 17.

First, at step S1702, the high DC charging voltage means is turned on. Then, by undergoing the processes at the steps S1703 through S1708, the value of the charging current Ic is determined at the point where the peak value of the charging AC voltage becomes equal to the peak value of the differential value of the charging AC voltage (at the point where the value Vac1' sampled by the voltage detecting circuit 202 becomes equal to the value Vac1 sampled by the voltage detecting circuit 201). In the case of the processing shown in FIG. 17, "the point at which a value becomes equal to" means the case where the value of the difference is less than 0.03V.

In the step S1703, the current control signal PRICNT is set to Vc1, while the charging AC voltage drive signal PRION is set to LOW level, to output the charging AC voltage. Further, the initial value of the current control signal PRICNT is set as Vc1'=Vc1 at the time when the peak value Vac1' of the differential value of the charging AC voltage is approximated to the peak value Vac1 of the charging AC. In this stage, the value of the Vc1 is set to the value that is sufficiently larger than the value of the charging current to be set finally so that the value can be controlled only for the direction of lowering in the later step S1707.

Following the setting of various parameters, at the step S1704, the value of PRIVS (the peak value Vac1 of the charging AC voltage), sampled by the voltage detecting circuit 201, is read, and, at the step SL705, the instantaneous voltage detect signal PRIDVS (the peak value Vac1' of the differential value of the charging AC voltage) sampled by the voltage detecting circuit 202, is read. Then, the processes of the steps S1705 through S1708 are repeated until the difference between the peak value Vac1 of the charging AC voltage and the peak value Vac1' of the differential value of the charging AC voltage is reduced by 0.1V to less than 0.03V, and the value of Vac1' is read to the current control signal PRICNT.

Figure 16B:
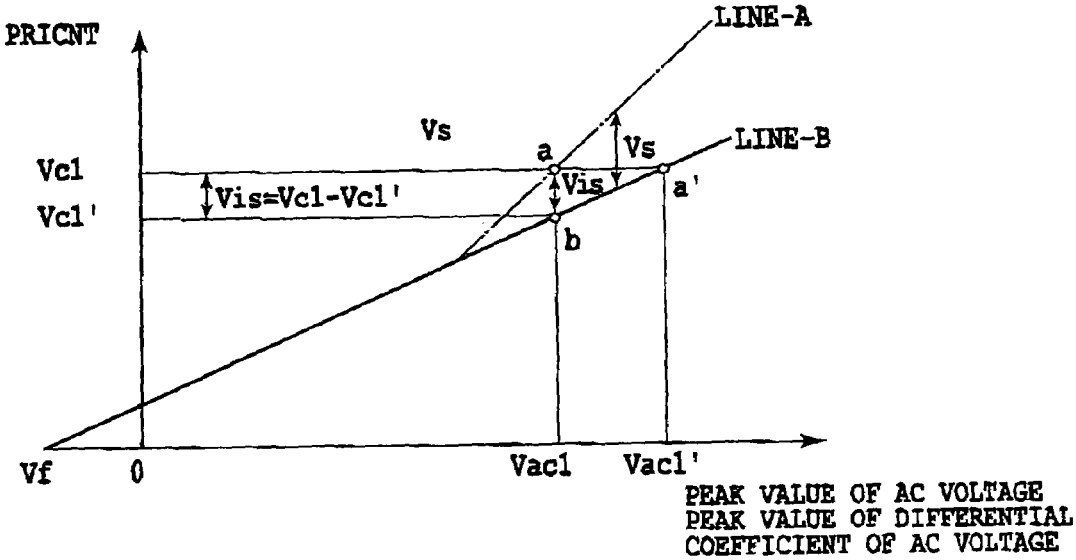

FIG. 16B shows the relationship between the peak value of the AC voltage/the peak value (on the y-axis) of the differential value of the AC voltage and the current control signal PRICNT (on the x-axis). Assuming that the value of the charging current satisfying the value required at the step S1706 is Iac1', the value of the controlling current corresponding to Iac1 is Vc1, while the current control signal corresponding to the current control signal is Vc1 is Vc1'. Hence, the difference Vis in voltage of the current control signal to the actual charging current Is' is set as Vis−Vc1−Vc1'.

Next, the processes of the steps S1709 through S1715 are executed to determine the value of the charging current at which the difference (in charging current) between the value of the characteristic line, LINE-A, and the value of the characteristic line, LINE-B, coincides with the predetermined value. First, at the step S1709, the sampled voltage, Vis=Vc1−Vc1', to the actual discharging current is determined, and, at the step S1710, the sampled voltage difference Vs, corresponding to the predetermined discharging current Is, is compared with Vis. When the value of the actual charging current (Is'=Iac1−Iac1') is larger than Is, that is, when Vs−Vis>0, the processing proceeds to step S1711, where whether Vis is larger than Vs by more than 0.03V is checked. At this stage, when (Vis) is found to be larger than (Vs) it should be (i.e., when Vis−Vs<0.03V does not hold), the processing proceeds to step S1712 to reduce the value of the Vc1 by 0.1V, and the processes from the step S1703 on will be repeated.

On the other hand, when the actual charging current (Iac1− Iac1') is smaller than Is and Vs>Vis, the processing proceed from step S1710 to step S1714 through the step S1713. More particularly, when Vs−Vis>0, the processing proceeds to the step S1713 to examine whether Vs−Vis= 0 or not, and when Vs−Vis≠0, whether Vs is larger than Vis by 0.03V or more is checked at the step S1714. In this stage, when (the Vs) is larger (when Vs−Vis<0.03V does not hold), the processing proceeds to the step S1715 to increase the value of the Vc1 by 0.1V, and then the processes from the step S1703 and on are repeated.

In the step S1713, when Vs is equal to Vis, or when the difference between Vis and Vs found to be less than 0.03V at the step S1711 or S1714, the charging current Iac1 will be outputted on the basis of the current control signal PRICNT=Vc1, as being the definite value, and the processing proceeds to the printing operation for the first sheet.

In the third embodiment, the minimum control range of Vc1 is defined to be 0.1V, and the control range is set to 0.03V, (approximately the double value) of the minimum control range, but any values closer to 0 may be chosen for the minimum control range depending on the actual composition of the circuit and the processing speed and thus the control range is not limited to the values applied in the third embodiment. Further, the process for controlling Vc1 characterized by that the value of Iac1 is reduced starting from the value having a sufficiently large magnitude, but the control of the Vc1 may be started from sufficiently small value.

(2) Process in Printing

What has been discussed in the foregoing is concerned with the process for determining the level of the high charging AC voltage in starting the printing operation for the first sheet.

Figure 18:
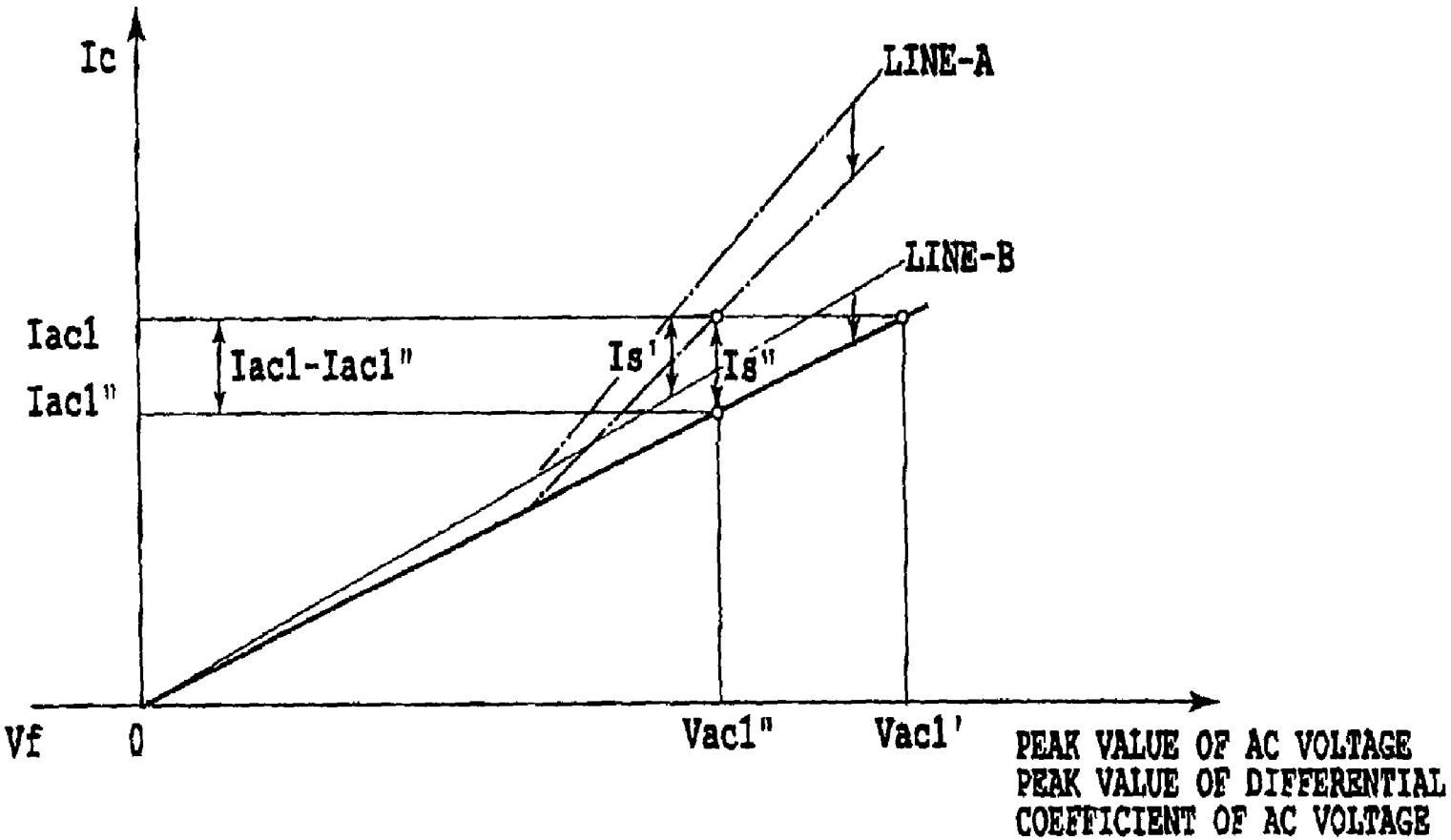
FIG. 18 is a diagram representing the characteristic of the detect signals before and after the printing process of the third embodiment.

In carrying out the printing operation continuously, the charging characteristic is apt to vary from the initial state thereof owing to the effect of the change in the temperature of the charge roller or the contamination on the surface thereof. FIG. 18 shows, for example, the characteristics of the charging alternating current (on the y-axis), the peak value of the charging AC voltage and the peak value (on the x-axis) of the differential value of the charging AC voltage respectively at the point before the printing operation and at the point after printing 500 sheets. In FIG. 18, the thin solid line (representing the peak value of the differential value of the charging AC voltage) and the thin alternate long and short dash line (representing the peak value of the charging AC voltage) show the initial characteristics of these factor, while the thick solid line and the thick alternate long and short dash line represent the characteristics of the same factors after the continuous printing operation.

In the third embodiment, the previously mentioned current control signal PRICNT is controlled by the defined value of Vc1, so that, as shown in FIG. 18, as the inclinations of the characteristic lines, LINE-A and LINE-B, become smaller than the inclinations of the initial characteristics lines, the value of actual charging current Is' increases to Is". In other words, when the peak voltage Vac1' of the differential value of the charging AC voltage is made equal to the peak voltage Vac1 of the charging AC voltage, the charging current Iac1' becomes smaller than Iac1'. Hence, the actual discharging current Is" after the continuous printing operation becomes larger than the actual discharging current Is' at the initial stage of the printing operation.

Thus, in the case of the continuous printing operation according to third embodiment, even after the processing has entered the printing process, the level of the high AC charging voltage is determined again to correct the setting of the AC voltage on the basis of the re-determined AC voltage level. Such setting adjustment processing in the third embodiment is made each time the continuous printing of 50 sheets is finished starting from the standby state and the subsequent start of the printing operation. The timing (for such re-determination of the charging voltage) will be determined on the basis of he reading of the counter for counting the number of the printed sheets incorporated into the CPU245. The high AC charging voltage during the process of the printing operation is adjusted by the processing similar to the processing shown in FIG. 17.

After adjusting processing is completed, the counter for counting the number of printed sheets is reset, and the same adjusting processing for the high AC charging voltage is repeated each time the continuous printing of 50 sheets has finished. The interval of such adjusting process need not be limited to the interval for the continuous printing of 50 sheets and thus any other interval based on the number of the printed sheets may be chosen in consideration of the reading of the counter.

As discussed in the foregoing, in the case of the control of the charging high voltage according to the third embodiment, the nip current is sampled on the basis of the measured peak value of the differential value of the high AC charging voltage. With the system composed as described in the foregoing, it becomes possible to sample the nip current within the range of the discharge, so that the charging current can be controlled with high accuracy. Hence, it becomes possible to obtain a uniform charge without giving rise to the problems such as the deterioration of the photoconductor drum or the poor image formation or the like, irrespective of the change in the environmental condition or the variation of the characteristic of the charging member owing to the manufacturing process. Further, during the continuous printing operation, not only the resetting of the charging current can be made without increasing the charging current from the present level but also, even during the continuous printing operation, a uniform charge can be attained without giving rise to the problems such as the deterioration of the photoconductor drum or the poor image formation, irrespective of the change in the environmental condition or the variation of the characteristic of the charging member owing to the manufacturing process.

Furthermore, according to the third embodiment, each time the printing of the predetermined number of sheets is finished, the resetting of the charging voltage level is repeated to control the charging voltage, so that, even when the condition of the image forming apparatus varies depending on the operating condition thereof, it is possible to always keep the photoconductor drum charged optimally.

(The Fourth Embodiment)

The fourth embodiment of the present invention will be described in the following. In the first embodiment and the third embodiment, the peak value of charging AC voltage and the peak value of the differential value of the charging AC voltage are detected, and the discharging current is determined directly from the difference between the value of the charging current at the time when the peak value of the differential value of the charging AC voltage is equalized with the peak value of the charging AC voltage, and the value of the charging current obtained in this way is controlled to a constant level.

Figure 19A:
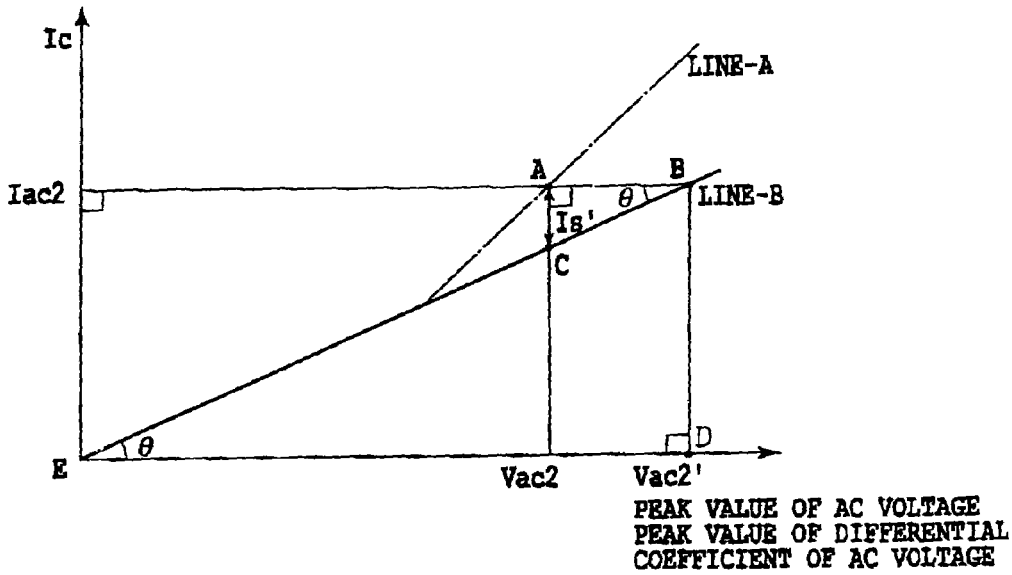
FIGS. 19A and 19B are diagrams showing the characteristics of the detect signals in the third embodiment.
Figure 19B:
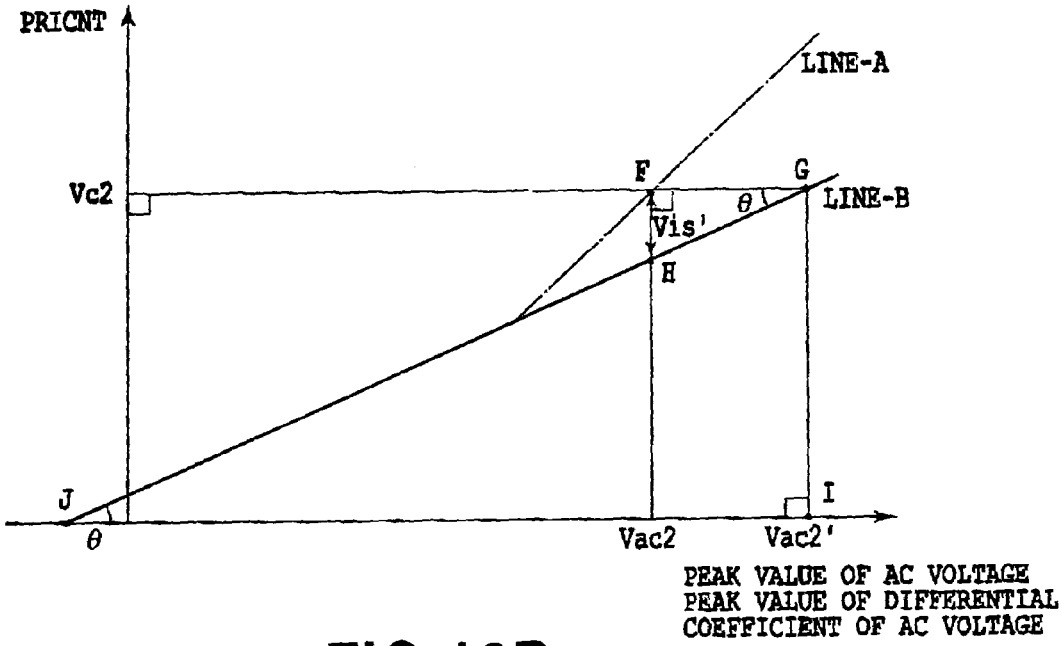

In the fourth embodiment, the peak value of the charging AC voltage, controlled with the predetermined charging current, and the peak value of the differential value of the charging AC voltage are obtained respectively, and the value of the charging current is controlled on a real-time basis by calculating the actual discharging current Is' on the bases of the similar relationships shown in FIG. 19A and FIG. 19B. The description of the high charging AC voltage output circuit is omitted here, since being similar in composition to the diagrams of the first and the third embodiments shown in FIG. 3.

In FIG. 19A, when the AC voltage is outputted so that the predetermined charging current value Ica2 can be obtained, the triangle ABC and the triangle BDE are similar to each other, since these triangles include the alternate-interior angles θ being equal to each other and the right angles. The base of the triangle ABC coincides with the difference (Vac2'−Vac2) between the peak value Vac2' of the differential value of the charging AC voltage and the peak value Vac2 of the charging AC voltage, whereas the base DE of the triangle BDE coincides with the peak value Vac2' of the differential value of the charging AC voltage. Further, the height AC of the triangle ABC coincides with the actual discharging current Is', while the height BD of the triangle BDE coincides with the charging current Iac2.

Hence, from these relationships the actual discharging current Is' can be obtained by the following equation.

$$Is'=(1-Vac2/Vac2')Iac2 \quad (14)$$

Figure 20:
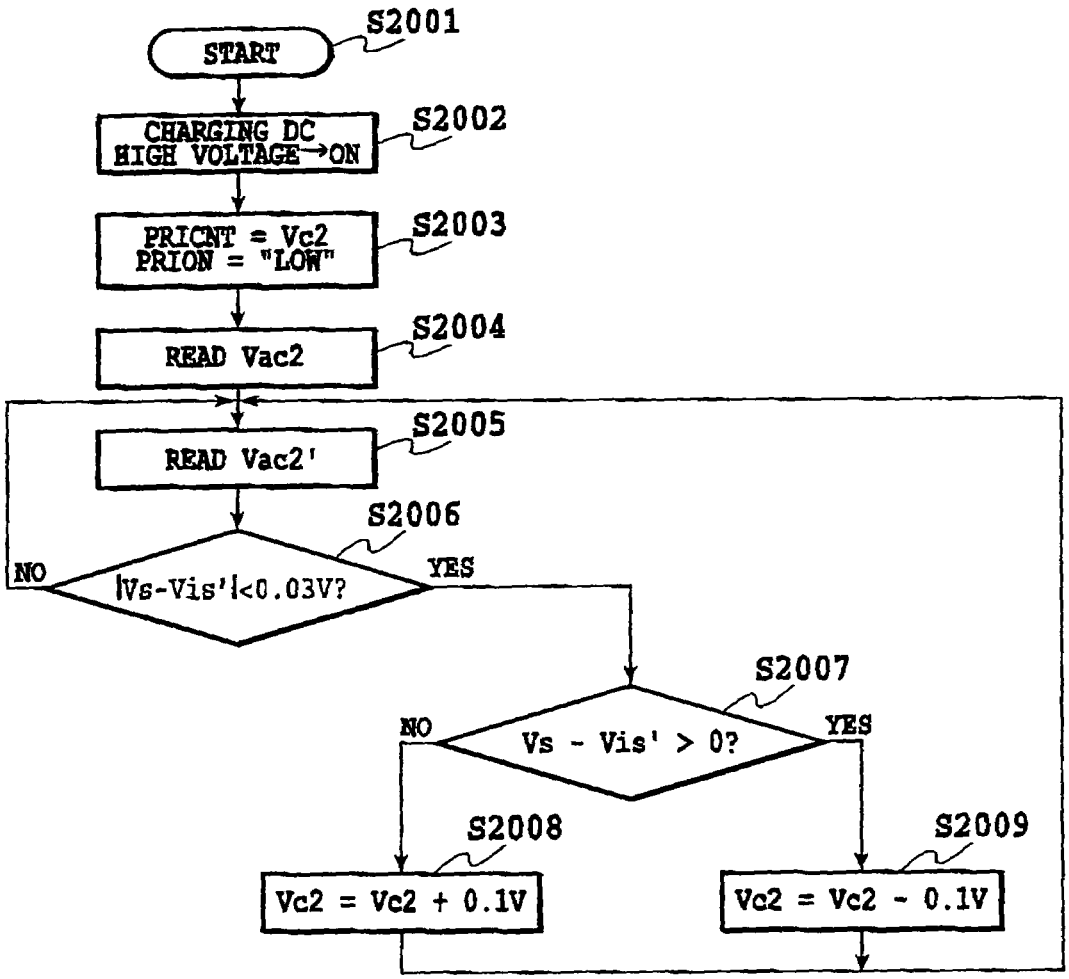
FIG. 20 is a flowchart representing the processes of the fourth embodiment.

Next, the processing for controlling the actual discharging current Is' to the predetermined value Is, referring to the flowchart given in FIG. 20.

When the operation of the image forming apparatus proceeds to the printing process from the standby state, the processing for determining the level of the high AC discharging voltage is carried out during the pre-rotation period.

When the above processing is started, the DC high charging voltage is turned on at the step S2002. Then, at steps S2003 through S2005, the value Ic of the charging current is obtained; the value of the Ic, for this purpose, is required to be at the level for equalizing the peak value of the charging AC voltage with the peak value of the differential value of the charging AC voltage (i.e., when the Vac1' sampled by the voltage detecting circuit 202 becomes equal with the initial value Vac1 sampled by the voltage detecting circuit 201). In the processing shown in FIG. 20, "the value for equalizing" means, similarly to the case of the third embodiment, the value at which the difference becomes less than 0.03V, but the equalizing value of Ic is not limited to this value as mentioned previously.

In the step S2003, the current control signal PRICNT is set to Vc2, and the charging AC voltage driving signal PRION is set to LOW level to output the charging AC voltage. In this stage, the value of Vc2 is finally set to a value that is sufficiently larger than the charging current value. Subsequently, at the step S2004, the value PRIVS (the peak value Vac2 of the charging AC voltage) sampled by the voltage detecting circuit 201 is read. Further, at the step S2005, the instantaneous voltage signal PRIDVS (the peak value Vac2' of the differential value of the charging AC voltage) sampled by the voltage detecting circuit 202 is read.

FIG. 19B shows the relationship between the peak value of the AC voltage/the peak value (on the x-axis) of the differential value of the AC voltage and the current control signal PRICNT (y-axis). FIG. 19B shows that, when Vac2, as being the value of the current control signal PRCNT, is inputted, the AC peak voltage, i.e., Vac2 is applied to the charge roller to cause the charging current having the value of Iac2 to flow, and that the peak value of the differential value of the AC voltage becomes Vac2'.

Where the fall of the voltage in normal direction of the diode 288 and the diode 284 is given as Vf, since the triangle FGH and the triangle IJG are similar, the difference Vis' of the charging current control voltage corresponding to the actual discharging current Is' can be obtained by the following equation.

$$Vis'=Vac2'-Vac2/Vac2'+Vf\times Vc2 \quad (15)$$

In this stage, at the step S2006, the Vis is compared with the voltage difference Vs corresponding to the predetermined discharging current Is, and, when the absolute value of the difference is less than 0.03V, the processes of the steps S2004 through S2006 are repeated.

On the other hand, when the absolute value of the difference between Vs and Vis' is larger than 0.03V, the processing proceeds to the step S2007 to compare Vs with Vis' in magnitude. When the actual discharging current Vis' is smaller than the predetermined discharging current Vs (i.e., Vs−Vis'>0), the processing proceeds to the step S2008 to increase the input value Vc2 of the current control signal PRICNT by 0.1V, and then returns to the step S2004. On the other hand, when the actual discharging current Vis' is larger than the predetermined discharging current Vs (i.e., Vs−Vis'<0), the processing proceeds to the step S2009 to reduce the value of Vc2 by 0.1V, and then returns to the step S2004.

As discussed above, by controlling the input value Vc2 of the current control signal PRICNT on the real time basis, the level of the discharging current to flow in the charge roller not only can be kept to the predetermined value from the start of the charging control but also can be controlled even during the printing operation, so that the stable charging control can be made at all times.

In the fourth embodiment, the minimum control range of the Vc2 is set to 0.1V, while the minimum control range at the step S2006 is doubled to be set to 0.03V, but these control ranges can be selectively varied to as close as to 0V depending on the actual circuit composition and the processing speed and thus need not be limited to the values given in the fourth embodiment.

(The Fifth Embodiment)

Figure 21:
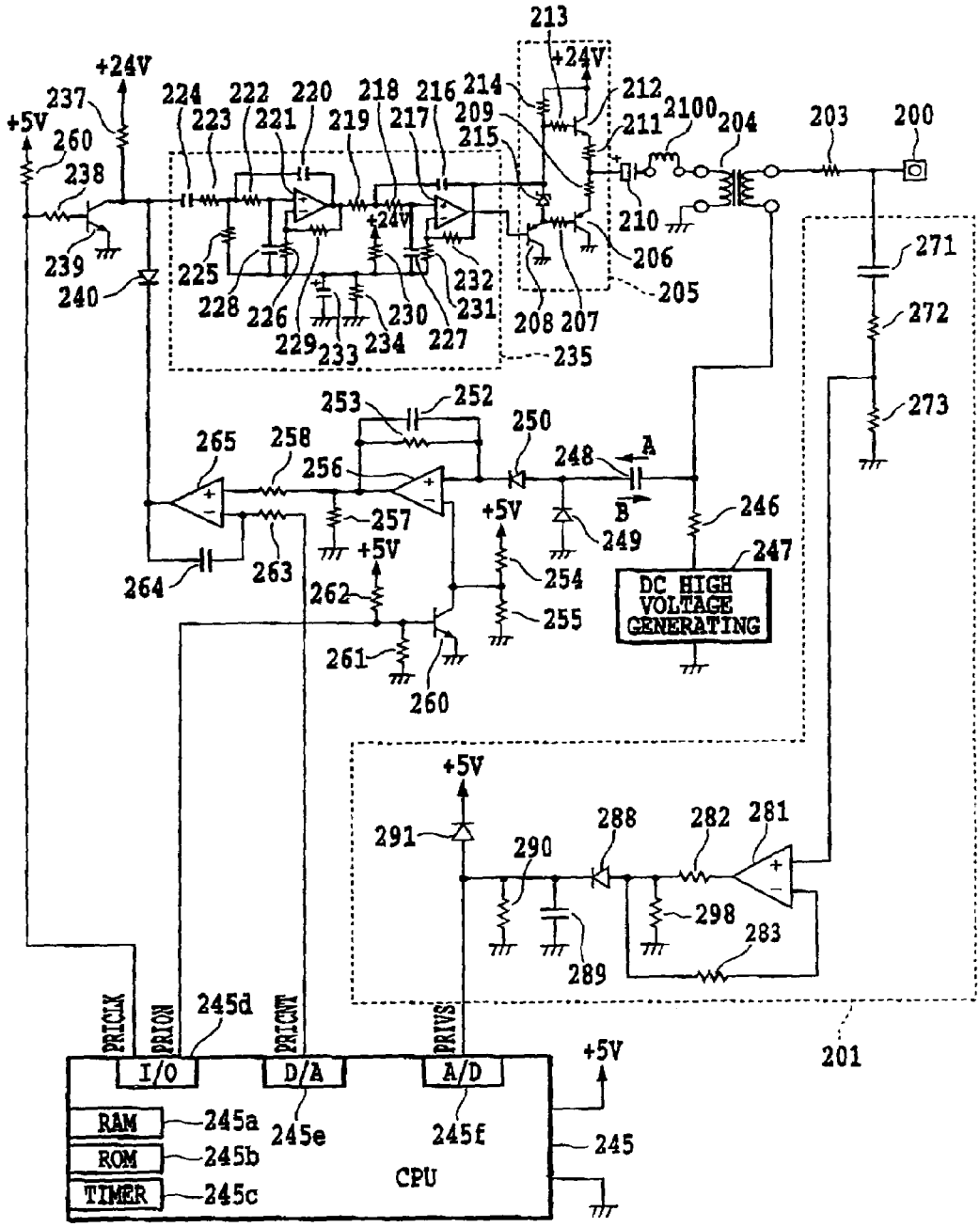
FIG. 21 is a charging high-voltage output circuit of the image forming apparatus as the fifth embodiment.

FIG. 21 shows the high AC charging voltage output circuit according to the fifth embodiment of the present invention. The present embodiment differs from the first embodiment in that the present embodiment does not comprise the voltage detecting circuit 202 but comprises a choke coil 100 provided between the primary winding side of a high-voltage transformer 204 and a capacitor 210.

In the present embodiment, when the level of the charging AC voltage exceeds the discharge starting voltage, the discharging current occurs in addition to the nip current. The sum of the nip current and the discharging current flows in the charge roller 2. In this case, even when the current in the primary winding of the high-voltage transformer increases instantaneously, the voltage drops on both the ends of the choke coil 2100, so that the input voltage to the high-voltage transformer 204 drops. Consequently, the waveform of the charging AC voltage fed to the charge roller 2 is modified thereby altering the characteristic of the discharging current corresponding to the charging high AC voltage to be applied.

Figures 22A, 22B, 22C:
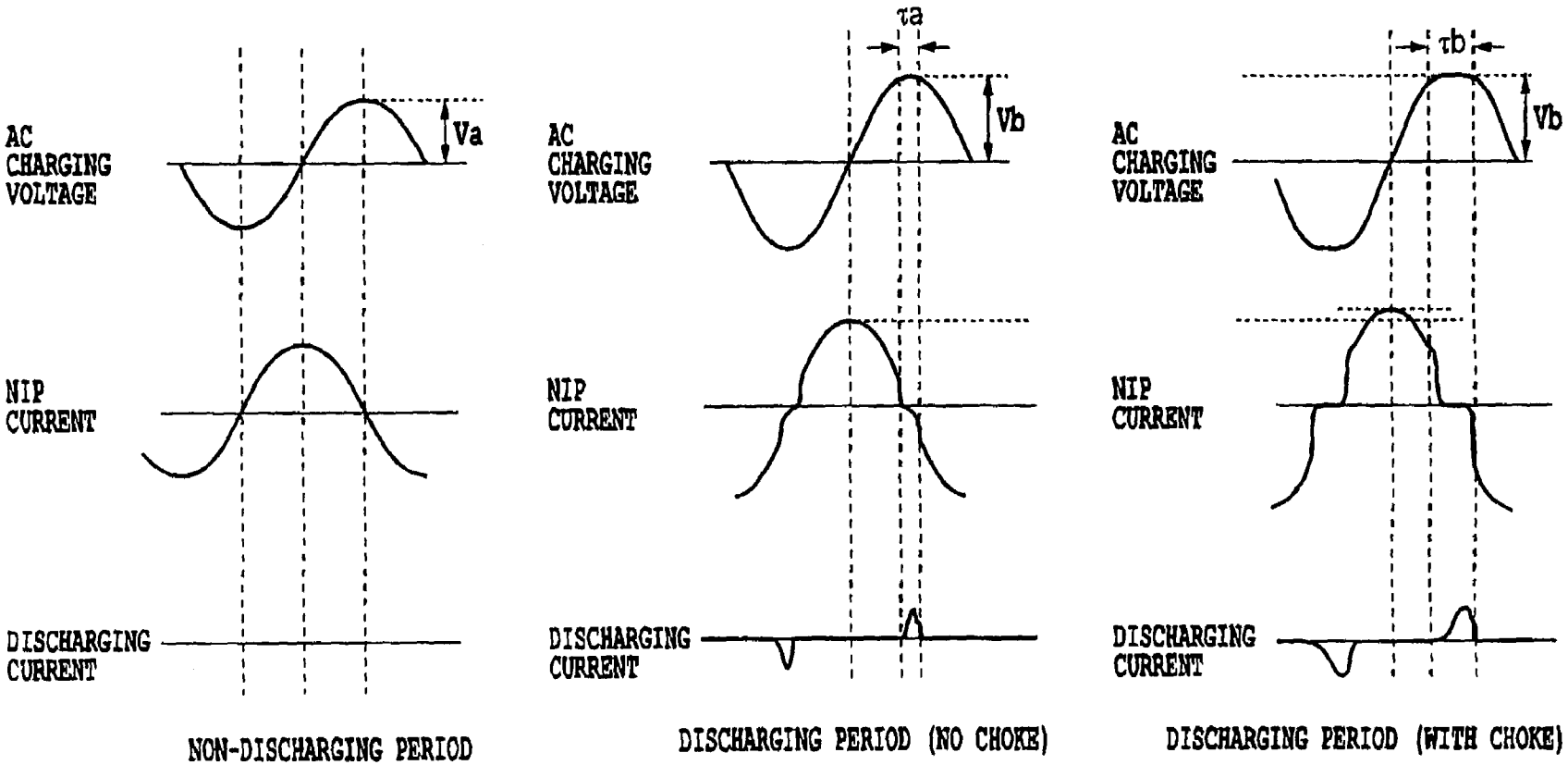

The waveforms of the nip current and the discharging current, at the time when the charging AC voltage whose peak value is equal to or higher than the discharge starting voltage is applied, are shown in FIG. 22C. Insertion of the choke coil 2100 brings about the increase in the distortion of the waveform of the charging AC voltage and the rise of the level of the discharging current Is. The discharging current Is flows during the same period as the period $\tau b$ wherein the distortion of the charging AC voltage occurs.

For comparison, the waveform of the nip current and the waveform of the discharging current where the discharging is not present, that is, in the range wherein the peak value of the charging AC voltage is lower than the discharge starting voltage, are shown in FIG. 22A. In this range, the nip current flows only when being in correspondence to the resistive load and the capacitive load between the charge roller 2 and the photoconductor drum 1.

Further, for comparison, the waveform of the nip current and the waveform of the discharging current where the choke coil 2100 is not inserted in the circuit of FIG. 21 are shown in FIG. 22B. The discharging current Is flows and the distortion occurs within the peak of the AC voltage when the peak value Vb of the AC voltage becomes higher than the discharge starting voltage. This occurs because of that the discharging current flows at the peak value of the AC voltage not only causing the current to flow abruptly and instantaneously in both the secondary winding and the primary winding of the high-voltage transformer 204 but also causing the drop of the output from the high-voltage transfer 204. Such drop of the voltage is caused by the leakage inductance component occurring in the primary winding and the secondary winding of the high-voltage transformer 204.

The distortion having the duration of $\tau a$ occurs in the vicinity of the peak of the charging AC voltage, and the waveform of the nip current is distorted accordingly. The discharging current Is flows during the same period of time with the time period of $\tau a(<\tau b)$.

Figure 23:
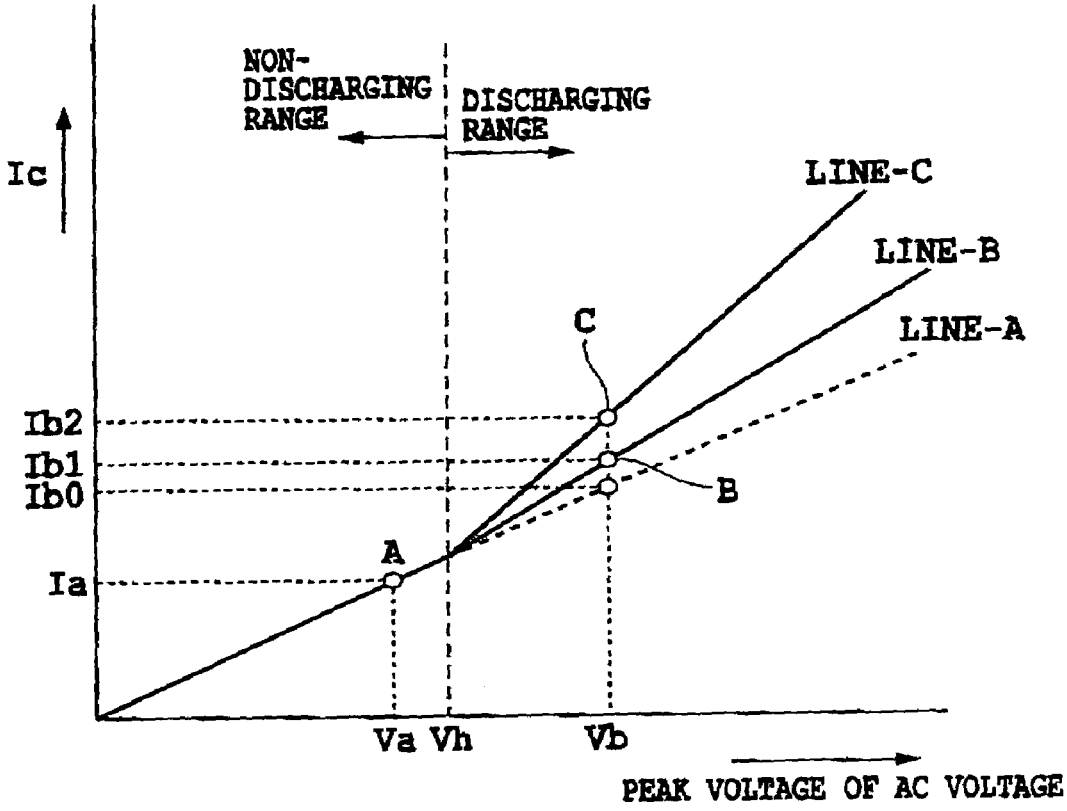
FIG. 23 is a characteristic diagram representing the charging AC voltage vs. the charging current in the fifth embodiment.

Next, the effect of the insertion of the choke coil 2100 will be described in more detail referring to FIG. 23. FIG. 23 shows the characteristics of the charging AC voltage and the charging alternating current, wherein the x-axis represents the peak value of the AC voltage, while they-axis represents the charging current Ic in terms of the average half-wave current value.

In FIG. 23, the line indicated by LINE-C represents the characteristic line (hereinafter referred to as "characteristic line, LINE-C") representing the characteristic line in the case where the choke coil is inserted; the line indicated by LINE-B represents the characteristic line (hereinafter referred to as "characteristic line, LINE-B") in the case where the choke coil 2100 is not inserted; the line indicated by LINE-A represents the characteristic line in the non-discharging range (hereinafter referred to as "characteristic line, LINE-A"). The points indicated as A, B and C correspond to the characteristics in the states as are shown in FIG. 22A, FIG. 22B and FIG. 22C respectively.

Within the range where the peak value of the AC voltage is lower than the discharge starting voltage Vh, the characteristics of the characteristic lines, LINE-B and LINE-C are equal to each other. However, within the range where (the peak value of the AC voltage is) equal to or higher than the discharge starting voltage Vh, the characteristic of the characteristic LINE-C differs from the characteristic of the characteristic LINE-B owing to (the presence or absence) of the choke coil 2100. In other words, the characteristic LINE-C is deviated from the characteristic LINE-A more than does the characteristic LINE-B.

Since there occurs a large difference between the characteristic LINE-C representing the case where the choke coil 2100 is inserted and the characteristic LINE-A in the discharging range, the insertion of the choke coil 2100, as in the case of the present embodiment, brings about the effect such as the increase in the magnitude of the discharge relative to the applied AC voltage.

Figure 24A:
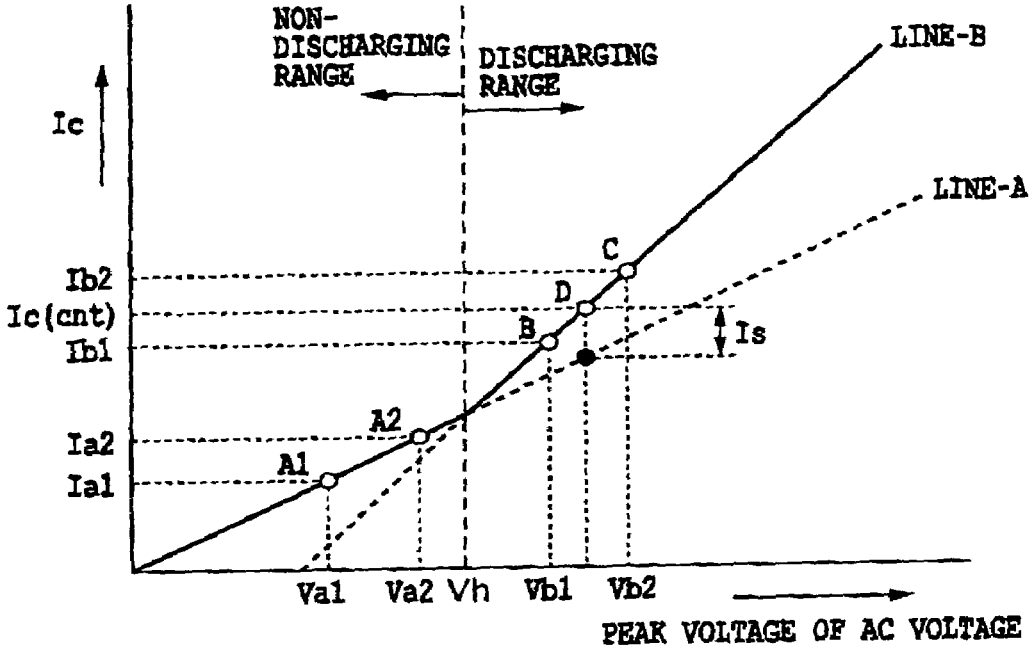
FIGS. 24A and 24B are diagrams illustrating the charging high-voltage control processes by the charging high-voltage output circuit according to the fifth embodiment.
Figure 24B:
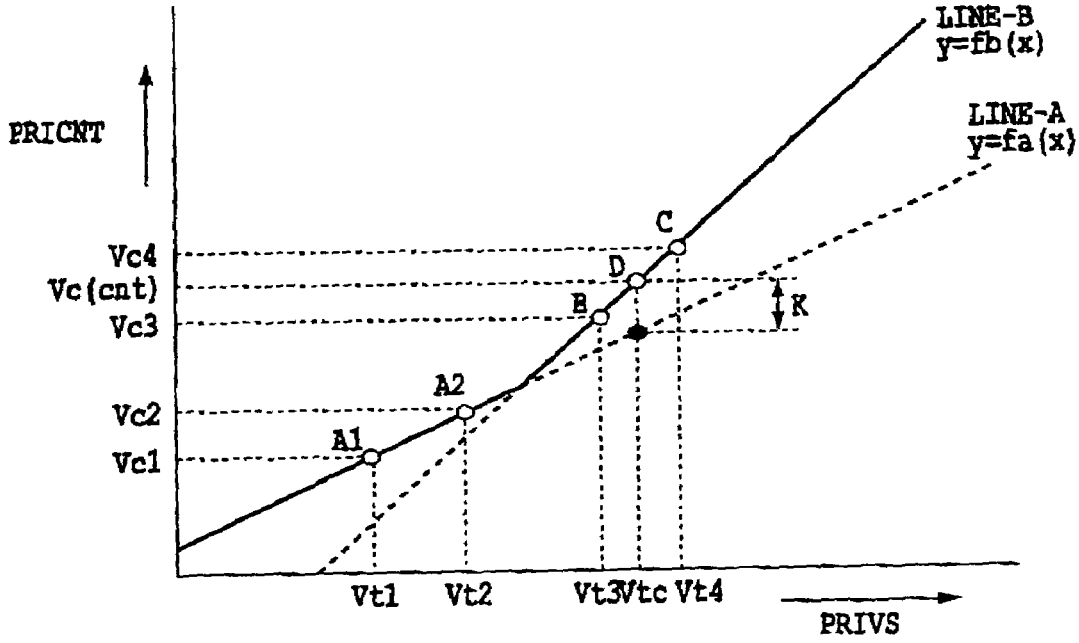

FIG. 24A shows the characteristic of the charging alternating current Is (on the y-axis) and the peak value of the charging AC voltage (on the x-axis) in case wherein the charging high AC voltage is applied to the charge roller 2. FIG. 24B shows the characteristics of the voltage detect signal PRIVS (on the x-axis) and the current control signal PRICNT (on the y-axis) corresponding to those shown in FIG. 24A. In FIG. 24A and FIG. 24B, the characteristic line, LINE-A, represents the characteristic line within the non-discharging range, while the characteristic line, LINE-B, represents the characteristic line within the charging range.

In the charge control according to the present embodiment, the equations for calculating the characteristics to be represented by the characteristic line, LINE-A, and the characteristic to be represented by the characteristic line, LINE-B, are derived in order for the value of the charging current at which the discharging current having the predetermined value to be calculated to determine the level of the charging high AC voltage applicable to the printing operation.

Figure 25:
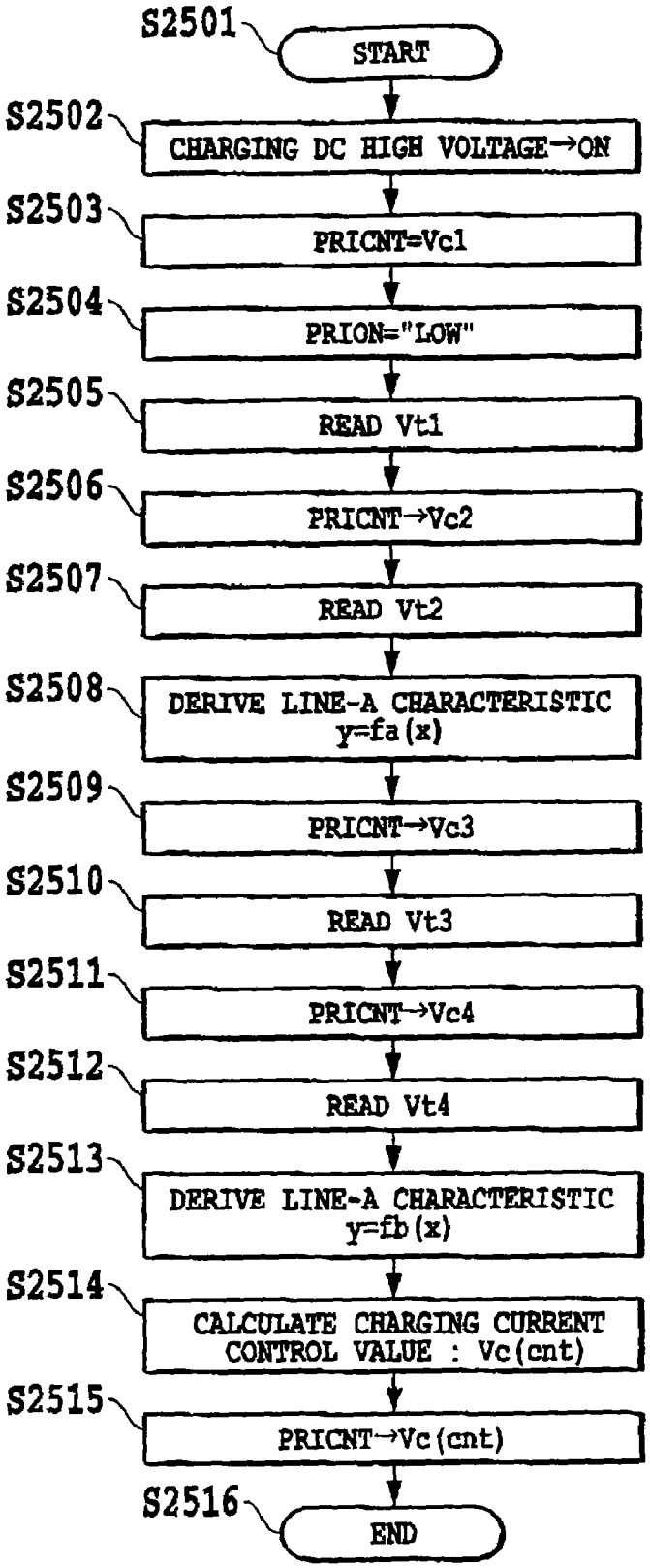
FIG. 25 is a flowchart illustrating an example of the charging control process according to the fifth embodiment.

FIG. 25 is a flowchart showing an example of a series of processes for determining the level of the charging high AC voltage. In the DC high voltage generating circuit 247, the charging high AC voltage is turned ON (S2502); after applying the predetermined DC bias to the charge roller 2, the characteristic of the characteristic line, LINE-A, is calculated at steps S2503 through S2508.

(1) Deriving Equation Representing Characteristic Line, LINE-A

The characteristic of the characteristic line, LINE-A, within the non-discharging range is calculated by sampling the point A1 and the point A2 within the non-discharging range given in FIG. 24A. First, the level of the charging current control signal PRICNT is set to Vc1 (S2503), and the charging alternating current ON signal PRION is switched to LOW level to apply AC voltage to the charge roller 2 (S2504). Then, the voltage detecting signal PRIVS at this time is detected and the sampling of A1 point is made (S2505) At this point, the value of the voltage detect signal PRIVS is set to Vt1.

Subsequently, the value of the charging current control signal PRICNT is switched to Vc2 (S2506), and the voltage detect signal PRIVS is sampled to sample the A2 point (S2507). In this case, the value of the voltage detect signal is set to Vt2. On the bases of the 2 points (i.e., the point A1 and the point A2) within the non-discharging range, y=fa (x), the characteristic formula, representing the characteristic of the characteristic line, LINE-A, is derived (S2508). Where b is given as a constant, y=fa (x) can be approximated by the equation given below.

$$y = fa(x) = ax + b \tag{16}$$

(2) Deriving Equation Representing Characteristic Line, LINE-B

In the steps S2509 through S2513, the characteristic of the characteristic line, LINE-B is calculated. The characteristic of the characteristic line, LINE-B, is calculated by sampling the points A and B within the discharging range shown in FIG. 24A. First, the level of the charging current control signal PRICNT is switched to Vc3 (S2509), and the voltage detect signal PRIVS at that time is sampled, the sampling of the point B will follow. In this case, the value of the voltage detect signal PRIVS is set to Vt3 (S2510).

The value of the charging current control signal PRICNT is switched to Vc4 (S2511), and the voltage detect signal PRIVS is sampled to be followed by the sampling of the point C. In this processing, the value of the voltage detect signal PRIVS is set to Vt4 (S2512). On the bases of 2 points, i.e., point B and point C, y=fb(x), the equation representing the characteristic of the characteristic line, LINE-B, is derived (S2513). Where c and d are given as constants, y=fb(x) can be expressed by the following equation.

$$Y = fb(x) = cx + d \tag{17}$$

In this case, the constants, c and d, differ largely and respectively from the constants, a and b, in the characteristic equation of the characteristic line, LINE-A. This results from the fact that there occurs a large difference in the characteristic between the characteristic line, LINE-A and the characteristic line, LINE-B.

(3) Determination of Charging Current Control Value

The level, Vc(cnt), of the charging current control signal PRICNT, at which the discharging current coincides with the predetermined value, is calculated (S2514). The discharging current corresponds to the difference between the characteristic line, LINE-B, and the characteristic line, LINE-A. In FIG. 24A, when the target value of the discharging current is set to Is, the target discharging current value Is can be obtained by controlling the charging current value to Ic (cnt). Hence, the level, Vc (cnt), of the charging current control signal PRICNT can be calculated by using the two characteristic equations, namely, y=fa (x) and y=fb (x), which have been derived by the processes described previously.

Where the range of the charging current control value PRICNT is set to ΔK, the value, Vt (cnt), of the voltage detect signal PRIVS, at which the target control value Is can be obtained, can be expressed by the following equations $$Vt(cnt)=(d-b+\Delta K/(a-c) \tag{18}$$

Vc (cent) can be expressed by the following equation.

$$Vc(cnt)=\{c(d-b+\Delta K)/(a-c)\}+d \tag{19}$$

(4) Setting Level of Charging Current for Printing Operation

The level of the charging current is switched to the level for the printing operation. The charging current control signal PRICNT is set to the value represented by Eq. (19) for the above-mentioned switching processing (S2515) thereby to complete the series of processing (S2516).

The optimal value of the charging current is obtained by proceeding through the above-mentioned series of processes, and the processing proceeds to the process of printing.

In the present embodiment, in controlling the charging current, there occurs difference (or errors) between the target control value Is of the discharging current and the actually available discharging current value owing to the variations of conditions occurring in the charging high voltage output circuit. The factors most responsible for the occurrence of such difference are the processes executed at the steps S2503 through S2514. For example, there are control errors occurring with the charging current control signals PRICNT (Vc1, Vc2, Vc3 and Vc4) and the sampling errors occurring with the charging voltage detect signal PRIVS (Vt1, Vt2, Vt3 and Vt4).

The occurrence of the control error and the sampling error such as those discussed above cause the occurrence of the errors in the process for calculating the charging voltage vs. charging alternating current characteristic (i.e., the characteristic lines, LINE-A and LINE-B) and the resulting error of the discharging current control value. The effects of such control error and the sampling error are inversely proportional to the difference between the characteristic line, LINE-A, and the characteristic line, LINE-B.

However, since the charging high voltage output circuit of the image forming apparatus according to the present embodiment comprises a choke coil 2100 provided on the primary winding side of the high-voltage transformer 204, the difference in the characteristic between the characteristic lines, LINE-A and LINE-B, can be increased. Hence, the previously mentioned effects of the control error and the sampling error on the actual discharging current are small. In other words, there is a large difference in characteristic between the charging AC voltage vs. the charging alternating current characteristic (the characteristic line, LINE-A) in the non-discharging range and the charging AC voltage vs. charging alternating current characteristic (the characteristic line, LINE-B) in the charging range, so that the charging alternating current for obtaining the desired charging current can be sampled with high accuracy.

Further, because of that the magnitude of the discharge relative to the charging AC voltage can be increased, the value of the necessary charging AC voltage, necessary for obtaining desired discharging current, can be reduced than that required conventionally, thereby enabling the sizes of the charging high voltage output circuit and the size of the image forming apparatus to be reduced.

As discussed in the foregoing, in the image forming apparatus according to the present embodiment, the predetermined charging current is applied to the charging high voltage output circuit, and the resulting charging voltage is sampled not only to sample the charging AC voltage vs.

charging alternating current characteristic (the characteristic line, LINE-A) in the non-discharging range and the charging AC voltage vs charging alternating current characteristic (the characteristic line, LINE-B) in the charging range but also to calculate the value of the charging alternating current, thereby obtaining the desired value of the charging alternating current for the optimal control. However, the optimal control of the charging alternating current value can also be realized by the system other than the present system. In other words, an alternative system may be employed so that the predetermined charging voltage is applied; the resulting charging current is sampled; the charging AC voltage vs. charging alternating current characteristic (the characteristic line, LINE-A) in non-charging range and the charging AC voltage vs. charging alternating current characteristic (the characteristic line, LINE-B) in the charging range are sampled; the value of the charging alternating current, at which the desired charging current is obtained for the optimal control.

(The Sixth Embodiment)

Figure 26:
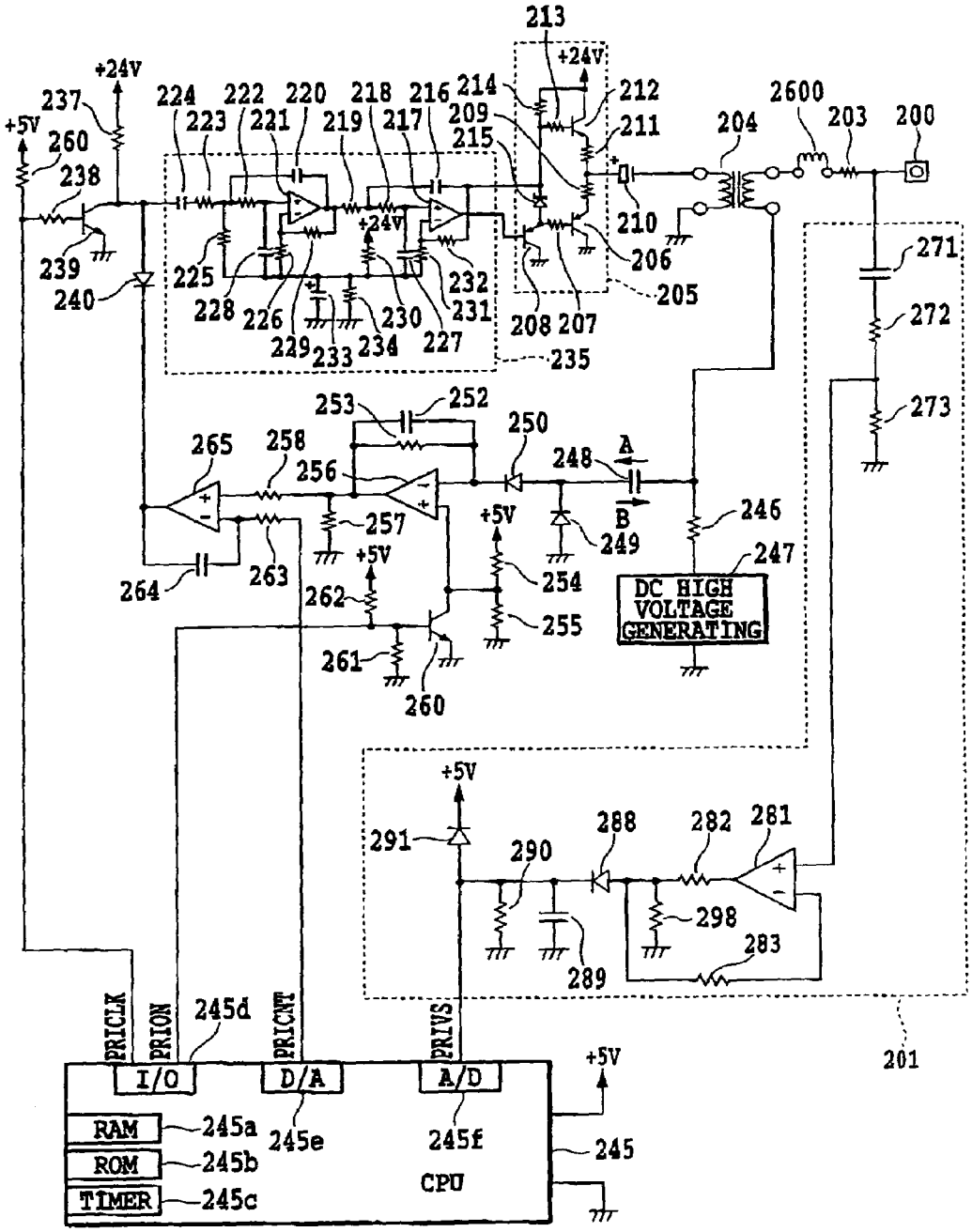
FIG. 26 is the charging high-voltage circuit diagram of the image forming apparatus according to the sixth embodiment.

An example of the charging high voltage output circuit in the image forming apparatus according to the present embodiment is shown in FIG. 26. The present embodiment differs from (the fifth) embodiment with respect to the location of the choke coil. More specifically, in the fifth embodiment, the choke coil 2100 is provided on the primary winding side of the high-voltage transformer 204, while, in the case of the present embodiment, the choke coil 2600 is provided on the secondary winding side of the high-voltage transformer 204.

In the charging high voltage output circuit shown in FIG. 26, the choke coil 2600 provided on the secondary winding side of the high voltage transformer 204 practically performs the same function as that of the choke coil 2100 (in the case of the fifth embodiment) provided on the primary winding side of the high voltage transformer 204. Hence, because of a large difference in characteristic between the charging AC voltage vs. charging alternating current characteristic (the characteristic line, LINE-A) in the non-discharging range and the charging AC voltage vs. charging alternating current characteristic (the characteristic line, LINE-B) in the charging range, the value of the charging alternating current, with which the desired charging current can be obtained, can be sampled with high accuracy.

(The Seventh Embodiment)

Figure 27:
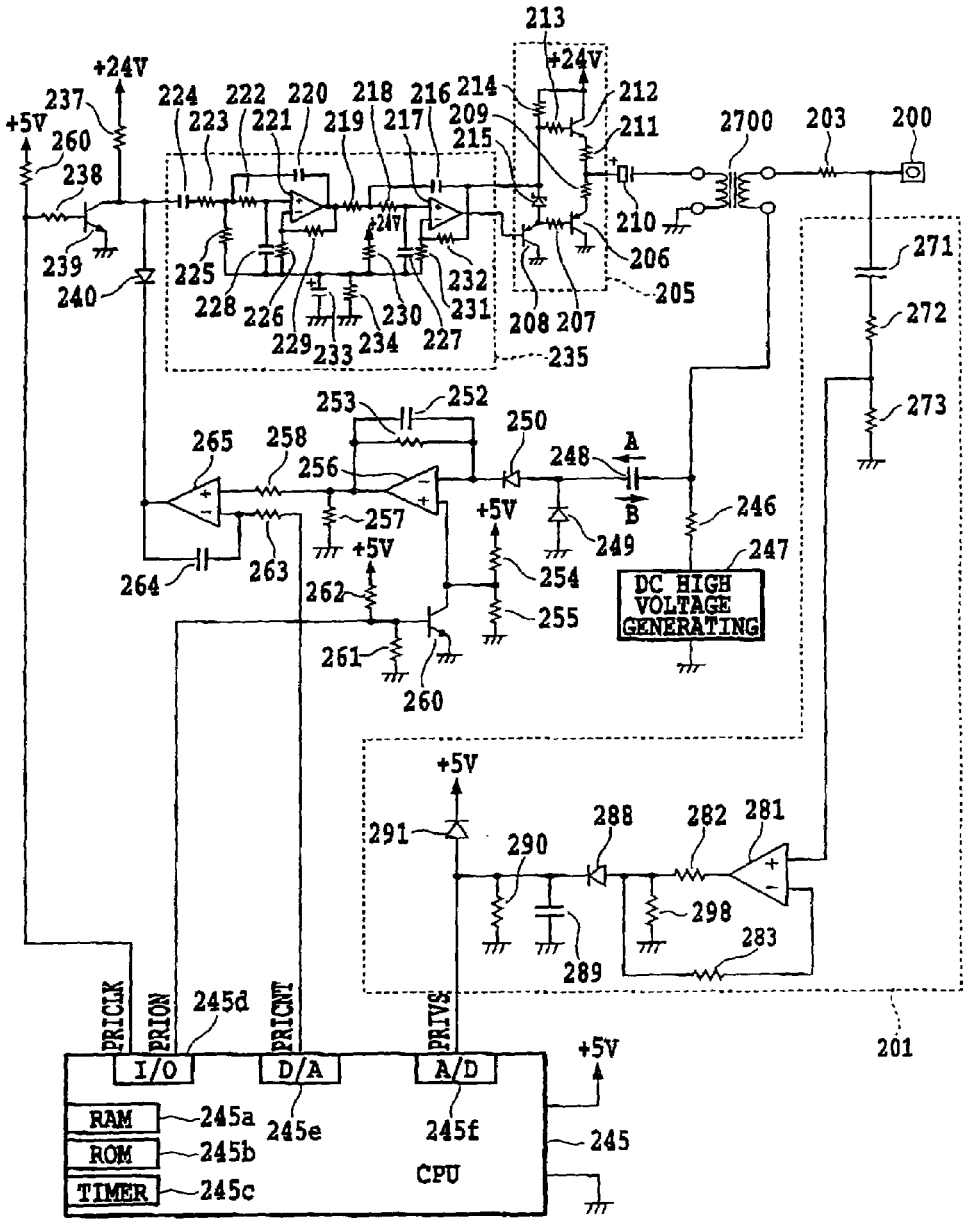
FIG. 27 is a charging high-voltage output circuit diagram according to the seventh embodiment.

The charging high voltage output circuit in the image forming apparatus according to the present embodiment is shown in FIG. 27. This charging high voltage output circuit differs from the fifth and the sixth embodiments in the composition of the output component designed for adjusting the waveform of the charging AC voltage. In the present embodiment, the high-voltage transformer 2700 of the charging high voltage output circuit is adopted as a substitute for the choke coil 2100 and the high-voltage transformer 204 in the fifth embodiment and also as a substitute for the high-voltage transformer 204 and the choke coil 2600 in the sixth embodiment.

Figure 28:
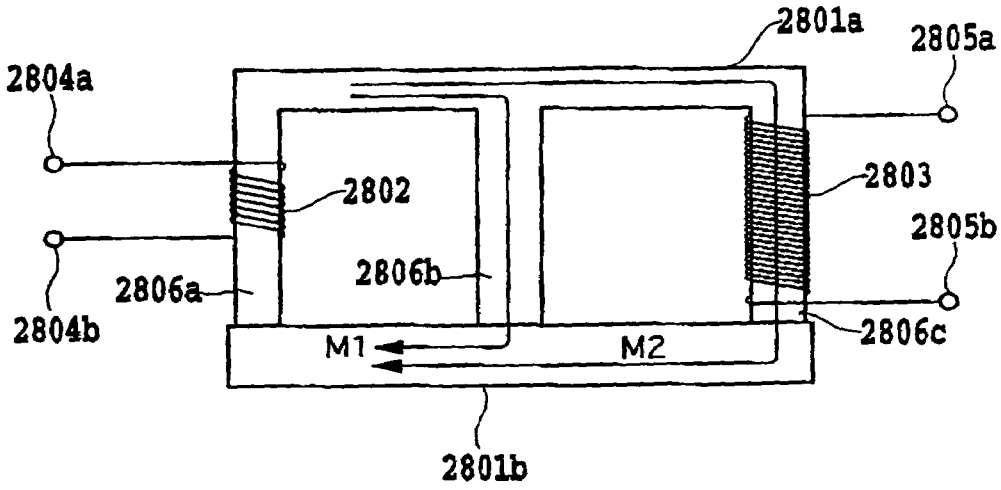
FIG. 28 is a sectional view illustrating the construction of the high-voltage transformer of the image forming apparatus according to the seventh embodiment.

For the high-voltage transformer 2700, one having the construction shown in FIG. 28 is adopted to reduce (the interdependency) between the primary winding side and the secondary winding side.

The high-voltage transformer 2700 comprises an EI-type core consisting of E-type core 2801A and I-type core 2801*b*. The E-type core comprises three parallel arranged parts, 2806*a*, 2806*b* and 2806*c*. The part 2806*a* is provided with the primary winding 2802, while the part 2806*c* is provided with the secondary winding 2803. The central part 2806*b* is not provided with any winding. Reference symbols 2804*a* and 2804*b* indicates the input terminal of the primary winding 2802. The reference symbols 2805*a* and 2805*b* indicates the output terminal of the secondary winding 2803.

The flow of the current in the primary winding 2802 causes the magnetic flux $\phi$ to be produced in the part 2806 of the E-type core thereby forming the magnetic loop M1 passing the central part 2806*b* of the core and the magnetic loop M2 passing the marginal part 2806*c*. Hence, the magnetic loop M2 intersects the secondary winding 2803.

Figure 29:
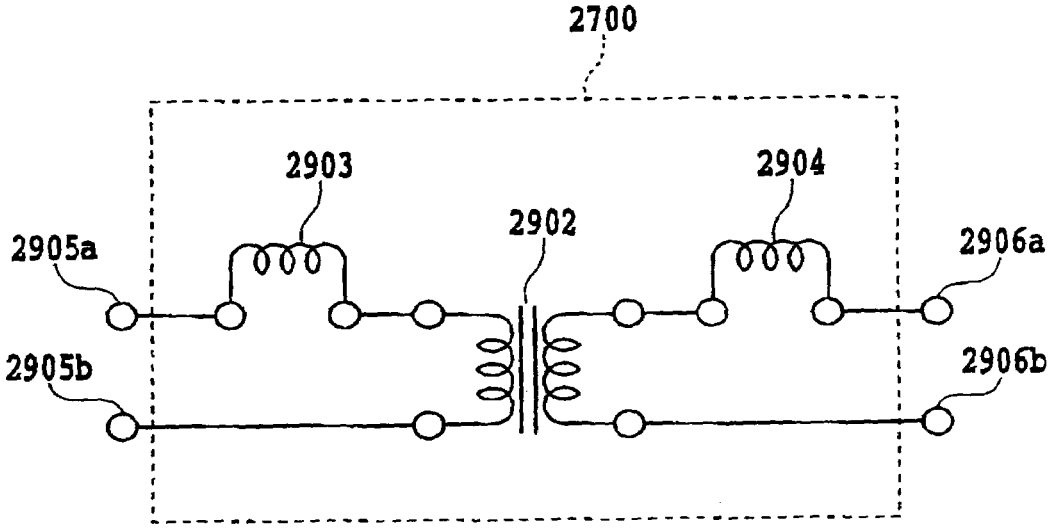
FIG. 29 is an equivalent circuit of the high-voltage transformer shown in FIG. 28.

The equivalent circuit of a high-voltage transformer 2700 is shown in FIG. 29. In FIG. 29, an input terminal 2905*a* is connected with one end of the primary winding of the transformer 2902 through an inductance element 2903, while an input terminal 2905*b* is connected with the other terminal of the primary winding of the transformer 2902. An output terminal 2906*a* is connected with one end of the secondary winding of the transformer 2902 through an inductance element 2904, while an output terminal 2906*b* is connected with the other end of the transformer 2902. The primary winding side and the secondary winding side of the transformer 2902 is highly (interdependent with each other).

As described in the foregoing, in the charging high voltage output circuit according to the present embodiment, the high-voltage transformer 2800 is equivalent to the transformer 2902 having an inductance element 2903 provided on the primary winding side thereof and an inductance element 2904 provided on the secondary winding side thereof. Thus, since the operation of the charging high voltage output circuit according to the present embodiment is substantially (similar) to the operations of the corresponding circuits according to the fifth embodiment and the sixth embodiment, in the present embodiment too, there is a large difference in characteristic between the charging AC voltage vs. the charging alternating current characteristic (the characteristic line, LINE-A) in the non-charging range and the charging AC voltage vs. charging alternating current characteristic (the characteristic line, LINE-B) in the charging range, so that the charging alternating current, with which the desired charging current can be obtained, can be sampled with high accuracy.

In the foregoing, the present invention relating to an image forming apparatus and the embodiments thereof have been described; however, besides the charging process of the image carrier, other processes relating to the charging control apparatus and the charging control are also available.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An apparatus for charging an image carrier and for transferring a latent image formed on said image carrier to form an image onto a recording medium, the apparatus comprising:

generating means for generating an AC voltage;

a charge member whereto AC voltage from said generating means is applied;

control means for controlling said generating means so as to flow a constant current according to a control value through a current path from said generating means to said charge member;

first output means for outputting an information according to a peak value of said AC voltage applied to said charge member; and second output means for outputting an information according to changes in said AC voltage applied to said charge member, wherein said control means sets said control value based on outputs from said first output means and from said second output means when said AC voltage generated by said generating means has a peak value equal to or higher than a discharge starting voltage of said image carrier.

2. The apparatus of claim 1, wherein said information according to said changes in said AC voltage, outputted from said second output means, is an information according to a peak value of a rate of change in said AC voltage.

3. The apparatus of claim 2, wherein said control means sets said control value, based on said information according to said peak value of said AC voltage, outputted from said first output means, and said information according to said peak value of said rate of change in said AC voltage, outputted from said second output means, such that a discharge current flowing from said charge member to said image carrier exhibits a predetermined value.

4. The apparatus of claim 3, wherein said control means, based on outputs from said first control means and said second output means when said control value is set to a first value and outputs from said first output means and said second output means when said control value is set to a second value, sets said control value to a third value such that said discharge current flowing from said charge member to said image carrier exhibits a predetermined value.

5. The apparatus of claim 4, wherein a value of said constant current according to said first value is smaller than a value of said constant current according to said second value.

6. The apparatus of claim 2, wherein said predetermined value is a constant value.

7. The apparatus of claim 1, wherein, when said AC voltage generated by said generating means has a peak value smaller than said discharge starting voltage of said image carrier, said first output means and said second output means produce equal outputs, and; when said AC voltage generated by said generating means has a peak value equal to or higher than said discharge starting voltage of said image carrier, a difference between an output value of said first output means and an output value of said second output means corresponds to a value of a discharge current flowing from said charge member to said image carrier.

8. The apparatus of claim 1, wherein said control means sets said control value for forming images, in forming an image on said recording medium, based on outputs from said first output means and said second output means.

9. The apparatus of claim 1, wherein said control means sets said control value for forming images based on a first control value whereby said first output means produces a first output value and a second control value whereby said second output means produces said first output value.

10. The apparatus of claim 1, wherein said information according to said changes in said AC voltage, outputted from said second output means, is an information according to a differential value of said AC voltage.

11. An apparatus for charging an image carrier and for transferring a latent image formed on said image carrier to form an image onto a recording medium, the apparatus comprising:

generating means for generating an AC voltage;

a charge member whereto AC voltage from said generating means is applied;

control means for controlling said generating means so as to flow a constant current according to a control value through a current path from said generating means to said charge member;

first output means for outputting an information according to a peak value of said AC voltage applied to said charge member; and second output means for outputting an information according to said AC voltage applied to said charge member when said AC voltage is in a predetermined phase, wherein said control means sets said control value based on outputs from said first output means and from said second output means when said AC voltage generated by said generating means has a peak value equal to or higher than a discharge starting voltage of said image carrier.

12. The apparatus of claim 11, wherein said control means, based on outputs from said first control means and said second output means, sets said control such that a discharge current flowing from said charge member to said image carrier exhibits a predetermined value.

13. The apparatus of claim 12, wherein said control means, based on outputs from said first control means and said second output means when said control value is set to a first value and outputs from said first output means and said second output means when said control value is set to a second value, sets said control value to a third value such that said discharge current flowing from said charge member to said image carrier exhibits a predetermined value.

14. The apparatus of claim 13, wherein a value of said constant current according to said first value is smaller than a value of said constant current according to said second value.

15. The apparatus of claim 11, wherein when said AC voltage generated by said generating means has a peak value smaller than said discharge starting voltage of said image carrier, said first output means and said second output means produce equal outputs, and;

when said AC voltage generated by said generating means has a peak value equal to or higher than said discharge starting voltage of said image carrier, a difference between an output value of said first output means and an output value of said second output means corresponds to a value of a discharge current flowing from said charge member to said image carrier.

16. The apparatus of claim 11, wherein said control means sets said control value for forming images, in forming an image on said recording medium, based on outputs from said first output means and said second output means.

17. The apparatus of claim 11, wherein said control means, based on a first control value whereby said first output means produces a first output value and a second control value whereby said second output means produces said first output value, sets a third control value.

18. The apparatus of claim 11, wherein said information according to said changes in said AC voltage, outputted from said second output means, is an information according to a differential value of said AC voltage.

19. The apparatus of claim 12, wherein said predetermined value is a constant value.

* * * * *

UNITED STATES PATENT AND TRADEMARK OFFICE

CERTIFICATE OF CORRECTION

PATENT NO. : 6,985,680 B2
APPLICATION NO. :10/793733
DATED : January 10, 2006
INVENTOR(S) : Hiroaki Sakai, et al.

It is certified that error appears in the above-identified patent and that said Letters Patent is hereby corrected as shown below:

ON THE COVER PAGE

IN THE ABSTRACT:

Line 6, “an” should read --a--.

COLUMN 1:

Line 26, “by” should read --in--.

COLUMN 2:

Line 26, “become” should read --becomes--;
Line 27, “become” should read --becomes--;
Line 28, “perk-to-peak” should read --peak-to-peak--; and
Line 45, “laps” should read --lapse--.

COLUMN 3:

Line 16, “if” should read --if it--.

COLUMN 4:

Line 16, “an” should read --a--;
Line 36, “an” should read --a--; and
Line 57, “the’ (second occurrence) should be deleted.

COLUMN 5:

Line 44, “characteristic” should read --characteristics--.

COLUMN 6:

Line 17, “ref erring” should read --referring--.

COLUMN 8:

Line 15, “generated-by” should read --generated by--; and
Line 59, “sources” should read --sources.--.

UNITED STATES PATENT AND TRADEMARK OFFICE

CERTIFICATE OF CORRECTION

PATENT NO. : 6,985,680 B2
APPLICATION NO. : 10/793733
DATED : January 10, 2006
INVENTOR(S) : Hiroaki Sakai, et al.

It is certified that error appears in the above-identified patent and that said Letters Patent is hereby corrected as shown below:

COLUMN 10:

Line 5, “whole the” should read --the whole--;
Line 14, “gives” should read --given--; and
Line 37, “apparatus” should read --apparatus.--.

COLUMN 13:

Line 51, “202. These values are” should read --202, are--; and
Line 61, “that” should be deleted; and “is” should read --being--.

COLUMN 14:

Line 8, “(S100B)” should read --S(1008)--; and
Line 60, “witching” should read --switching--.

COLUMN 15:

Line 34, “laps” should read --lapse--.

COLUMN 16:

Line 56, “calculates” should read --calculate--.

COLUMN 17:

Line 1, “Vc0,” should read --Vc0 is--; and
Line 29, “to” (first occurrence) should be deleted.

COLUMN 18:

Line 54, “step SL705,” should read --step S1705,--.

COLUMN 19:

Line 4, “”Vc1” should be deleted;
Line 7, “Vis-Vc1-Vc1’.” should read -- Vis=Vc1-Vc1’.--; and
Line 38, “found” should read --is found--.

UNITED STATES PATENT AND TRADEMARK OFFICE

CERTIFICATE OF CORRECTION

PATENT NO. : 6,985,680 B2
APPLICATION NO. : 10/793733
DATED : January 10, 2006
INVENTOR(S) : Hiroaki Sakai, et al.

It is certified that error appears in the above-identified patent and that said Letters Patent is hereby corrected as shown below:

COLUMN 20:

Line 7, "factor," should read --factors,--.

COLUMN 23:

Line 44, "of that" should be deleted; and
Line 62, "they-axis" should read --the y-axis--.

COLUMN 26:

Line 2, "equations" should read --equations.--; and
Line 55, "of that" should be deleted.

COLUMN 28:

Line 3, "indicates" should read --indicate--; and
Line 5, "indicates" should read --indicate--.

Signed and Sealed this

Eighth Day of August, 2006

JON W. DUDAS
*Director of the United States Patent and Trademark Office*